US005283386A

United States Patent [19]

Akutsu et al.

[11] Patent Number: 5,283,386

[45] Date of Patent: Feb. 1, 1994

[54] MUSICAL-TONE SIGNAL GENERATING APPARATUS AND MUSICAL-TONE CONTROLLING APPARATUS INCLUDING DELAY MEANS AND AUTOMATIC RESET MEANS

[75] Inventors: Takashi Akutsu, Akishima; Teruo Jinbo; Hitoshi Kato, both of Fussa; Naoaki Itoh, Higashimurayama, all of Japan

[73] Assignee: Casio Computer Co., Ltd., Tokyo, Japan

[21] Appl. No.: 934,101

[22] Filed: Aug. 21, 1992

[30] Foreign Application Priority Data

| | | | |
|---|---|---|---|
| Aug. 30, 1991 | [JP] | Japan | 3-220704 |
| Aug. 30, 1991 | [JP] | Japan | 3-220705 |
| Aug. 30, 1991 | [JP] | Japan | 3-220706 |
| Apr. 8, 1992 | [JP] | Japan | 4-87282 |

[51] Int. Cl.[5] ..... G10H 1/057; G10H 7/02

[52] U.S. Cl. ..... 84/603; 84/663; 84/DIG. 27

[58] Field of Search ..... 84/602-614, 84/627, 663, 634-638, DIG. 1, DIG. 27; 381/1-28

[56] References Cited

U.S. PATENT DOCUMENTS 5,138,925 8/1992 Koguchi et al. ..... 84/609

FOREIGN PATENT DOCUMENTS 2-179692 7/1990 Japan .
2-179693 7/1990 Japan .
2-179694 7/1990 Japan .
2-179695 7/1990 Japan .
2-179696 7/1990 Japan .
2-179697 7/1990 Japan .
2-179698 7/1990 Japan .
4-58291 2/1992 Japan .
4-58292 2/1992 Japan .
4-58293 2/1992 Japan .
4-58294 2/1992 Japan .
4-60595 2/1992 Japan .
4-60596 2/1992 Japan .
4-60696 2/1992 Japan .
4-60697 2/1992 Japan .
4-60698 2/1992 Japan .
4-60722 2/1992 Japan .
4-60723 2/1992 Japan .
4-60724 2/1992 Japan .
4-60725 2/1992 Japan .
4-60744 2/1992 Japan .
4-60746 2/1992 Japan .
4-60749 2/1992 Japan .
4-61097 2/1992 Japan .
4-62595 2/1992 Japan .
4-136994 5/1992 Japan .
4-93894 8/1992 Japan .

*Primary Examiner*—Stanley J. Witkowski
*Attorney, Agent, or Firm*—Frishauf, Holtz, Goodman & Woodward

[57] ABSTRACT

A musical-tone signal controlling apparatus includes a processor which executes a musical-tone controlling process on an input musical-tone signal supplied to the processor, the processor including a delay unit which executes a delay process on the input musical-tone signal; a first discriminator which determines whether or not the input musical-tone signal to be supplied to the processor has become null; a second discriminator which determines whether or not the output musical-tone signal processed by the processor has become null; and a reset circuit which automatically resets the delay unit when the second discriminator determines that the musical-tone signal processed by the processor has become null after the first discriminator determines that the input musical-tone signal to be supplied to the processor has become null.

17 Claims, 31 Drawing Sheets

| ch1 | - - - - - - | ch8 |
|---|---|---|
| Af : DECIMAL PORTION OF CURRENT ADDRESS | | |
| Ai : INTEGER PORTION OF CURRENT ADDRESS | | |
| Pf : DECIMAL PORTION OF PITCH DATA | | |
| Pi : INTEGER PORTION OF PITCH DATA | | |
| OLD Ai : INTEGER PORTION OF CURRENT ADDRESS BEFORE CHANGE | | |
| Al : LOOP START ADDRESS | | |
| Ae: LOOP END ADDRESS | | |
| Xp : PREVIOUS SAMPLE VALUE | | |
| Xpl : SAMPLE VALUE OF Al | - - - - - | |
| D : DIFFERENCE VALUE OF SAMPLE VALUES | | |
| BK : WITHIN-BLOCK COUNTER | | |
| ADR : CURRENT ADDRESS OF QUANTIZED VALUE | | |
| Δx : ACCUMULATED DATA | | |
| Δxt : Δx TIMER VALUE | | |
| Δy : ACCUMULATED ENVELOPE VALUE WITH FLAG FOR ADDER/SUBTRACT OPERATION | | |
| OE : TARGET ENVELOPE | | |
| E : CURRENT ENVELOPE | | |
| O : OUTPUT | | |

FIG.7

B : ACCUMULATING BUFFER

FIG.8

| PROCESS NUMBER | FUNCTION | COUNTER LATCH (4MSB) (4LSB)(H) | LATCH CLOCK | FAS-A INPUT GATE CLOCK | FAS-B INPUT GATE CLOCK | ZNSA (A ← 0) | ZNSB (B ← 0) | NSSUB (SUBTRAC-TION) |
|---|---|---|---|---|---|---|---|---|
| 1 | $\Sigma^{-1} \leftarrow \Sigma$ | 0 2 | SIG1CK | SIGGT | — | 0 | 1 | 0 |
| 2 | $\Sigma \leftarrow$ INPUT LATCH | 0 3 | SIGCK | — | — | — | — | — |
| 3 | $T2 \leftarrow \Sigma^{-1} + Dz$ | 0 4 | TM2CK | DZGT | SIG1GT | 0 | 0 | 0 |
| 4 | $\Delta/4 \leftarrow \frac{\Sigma - \Sigma^{-1}}{4}$ | 0 5 | DEFCK | SIGGT | SIG1GT | 0 | 0 | 1 |
| 5 | $T1 \leftarrow \Sigma^{-1}$ | 0 6 | TM1CK | — | SIG1GT | 1 | 0 | 0 |
| 6 | $T2 \leftarrow T2 - Z^{-2}$ | — 8 | TM2CK | TM2AGT | Z2GT | 0 | 0 | 1 |
| 7 | $T2 \leftarrow T2 + 2 \times Z^{-1}$ | — 9 | TM2CK | TM2AGT | Z12GT | 0 | 0 | 0 |
| 8 | $Z^{-2} \leftarrow Z^{-1}$ | — A | Z2CK | — | Z11GT | 1 | 0 | 0 |
| 9 | 16 MORE SIGNIFICANT BITS → O; T2 → $Z^{-1}$; 3 LESS SIGNIFICANT BITS | — B | DACK Z1CK | TM2AGT | — | 0 | 1 | 0 |
| 10 | $T1 \leftarrow T1 + \Delta/4$ | — C | TM1CK DZCK | TM1GT | DEFGT | 0 | 0 | 0 |
| 11 | $T2 \leftarrow T1$ | — D | TM2CK | TM1GT | — | 0 | 1 | 0 |
| 12 | $T2 \leftarrow T2 + Dz$ | — E | TM2CK | DZGT | TM2BGT | 0 | 0 | 0 |

FIG. 29

MUSICAL-TONE SIGNAL GENERATING APPARATUS AND MUSICAL-TONE CONTROLLING APPARATUS INCLUDING DELAY MEANS AND AUTOMATIC RESET MEANS

BACKGROUND OF THE INVENTION

The present invention relates to a musical-tone signal generating apparatus having a general purpose processor and a processing circuit externally connected therewith, both of which cooperate with each other to perform a process for generating a musical-tone signal and a process for controlling the generated musical-tone signal.

Further, the present invention relates to a musical-tone controlling apparatus which performs on a generated musical-tone signal a musical-tone controlling process including a delay process such as a noise shaping process.

In a conventionally proposed technique, a general purpose processor is employed for generating a musical-tone signal through a software process. A musical-tone signal generating apparatus using the general purpose processor is capable of performing a wider variety of sound-source processes than that employing LSI designed for a special purpose of generating musical-tone signals, and further a reduction in manufacturing costs of the former apparatus can be expected.

The musical-tone signal generating apparatus employing the general purpose processor processes operations of various function keys as keyboard keys and tone-color keys through a general program routine, and generates musical-tone sample data at respective sampling timings through interrupt processes based on timer interrupts caused at predetermined intervals.

The musical-tone signal generating apparatus employing the general purpose processor, however, needs a longer time for executing an arithmetic operation compared with the apparatus employing a special LSI. Accordingly, the musical-tone signal generating apparatus employing only the general purpose processor is not suitable for executing musical-tone control processes which include a rapid arithmetic operation such as an over sampling process, a noise shaping process and dither process.

To overcome the above drawbacks, the general purpose processor is provided with an independent processing circuit externally connected therewith for executing the above musical-tone control processes.

In the apparatus including the externally connected processing circuit in addition to the general purpose processor, when the general purpose processor generates musical-tone sample data through an interrupt service executed at predetermined intervals, a time required for performing a sound-source process to generate the musical-tone sample data at respective timings varies depending on how a program is executed. As a result, the musical-tone sample data are not precisely generated at even intervals. Therefore, timings at which respective musical-tone sample data are generated from the general purpose processor are shifted from timings at which the processing circuit executes the musicaltone controlling process on the respective musical-tone sample data. As described above, the apparatus including the externally connected processing circuit in addition to the general purpose processor has a drawback that allows the musical-tone controlling process to be executed out of synchronism with generation of the musical-tone sample data.

Further, the musical-tone sample data generated by the general purpose processor are temporarily held, for example, in a buffer circuit such as a latch provided in an input portion of a processing circuit, and then are processed by hardware provided in the processing circuit.

Now, consider operation of the conventional musical-tone signal generating apparatus having the above mentioned processor and processing circuit, the operation which is executed when the power is applied.

The processor starts running a predetermined program when the power is turned on, and usually initializes, at the beginning of the program, memories, registers and output latches for outputting the generated musical-tone sample data within the processor, whereby the processor is controlled not to output undesired musical-tone sample data when the power is turned on.

A certain time is needed before the program starts running after the power is applied to the apparatus. Some time (a little time) therefore is required before the above initializing process is executed by means of software.

Meanwhile, since the hardware processing circuit externally connected to the processor starts operation independently of operation of the processor at the time when the power is turned on, contents of the musical-tone sample data held in the input latch provided in the input portion is not kept unchanged for a little time before the above output latch within the processor is reset by means of software.

As described above, the conventional musical-tone signal generating apparatus has drawbacks that the contents of the input latch is processed in the processing circuit, and has the possibility of outputting the resultants through D/A convertor as noise.

Further, when musical-tone controlling processes including a delay process such as the noise shaping process are executed on the generated musical-tone signal, an effect of delay process on the musical-tone signal will be realized as follows: that is, the musical-tone signal at the present sample timing is held in the buffer circuit such as the latch, and is read out at a later sample timing.

In the musical-tone controlling process including the above delay process, a musical-tone signal at the previous sampling timing is delayed by the buffer circuit and is used at the current sampling timing.

It is preferable for the above musical-tone controlling process that when an amplitude of an input musical-tone signal becomes null, the resultant or output signal of the control process becomes null accordingly, but the conventional musical-tone signal generating apparatus has a drawback that even if the amplitude of the input musical-tone signal becomes zero, undesired noise might be output due to signal components previously remaining in the buffer circuit.

SUMMARY OF THE INVENTION

The first and second themes of the present invention are to provide a musical-tone signal generating apparatus having a general purpose processor and a processing circuit externally connected to the general purpose processor, in which apparatus a musical-tone generating process to be executed by the general purpose processor may be performed precisely in synchronism with various musical-tone controlling processes to be executed by the externally connected processing circuit, whereby a precise and complicated musical-tone control can be effected on a musical-tone signal.

According to the first and second aspects of the present invention, there is provided a musical-tone signal generating apparatus which comprises a general purpose processor and a processing circuit externally connected to the processor, the processor executing sound-source processing program at predetermined intervals or at a sampling timing, successively generating musical-tone sample data, and the processing circuit executing musical-tone controlling processes on the generated musical-tone sample data, such as an over sampling process, a noise shaping process and a dither process. The musical-tone signal generating apparatus further comprises synchronizing means which holds the musical-tone sample data that has been generated by the general purpose processor through execution of a sound-source processing program, and inputs the musical-tone sample data to the processing circuit at predetermined intervals that are equivalent to the above predetermined sampling intervals.

The general purpose processor is designed to generate stereophonic musical-tone sample data, the processing circuit is designed to execute the musical-tone controlling process on the stereophonic musical-tone sample data in a time sharing manner and the synchronizing means is designed to hold the stereophonic musical-tone sample data generated by the processor and inputs the musical-tone sample data to the processing circuit at the above predetermined sampling intervals.

When the processor executes the sound-source processing program at predetermined intervals through the interrupt processes, generating the musical-tone sample data, times required for executing the sound-source processes every number of sampling timings to generate the musical-tone sample data are not constant because they change depending on how the program is being executed. Accordingly, the succeeding musical-tone sample data are not output from the processor at completely equivalent intervals.

Meanwhile, the synchronizing means holds the musical-tone sample data output from the processor, and outputs the same to the processing circuit at the predetermined output intervals which are in synchronism with the above predetermined sampling intervals.

As a result, the processing circuit receives the musical-tone sample data at precise intervals independently of the time needed by the processor to execute the sound-source process. The timings at which the processor outputs the musical-tone sample data can be synchronized with the timings at which the processing circuit executes the musical-tone controlling process on the respective musical-tone sample data.

The third theme of the present invention is to provide a musical-tone signal generating apparatus in which noises are suppressed that might be generated when the apparatus is turned on.

According to the third aspect of the present invention, there is provided a musical-tone signal generating apparatus which comprises a general purpose processor and a processing circuit externally connected to the processor, the processor executing a sound-source processing program, successively generating musical-tone sample data, and the processing circuit executing on the generated musical-tone sample data a musical-tone controlling process such as an over sampling process, a noise shaping process and a dither process. The musical-tone signal generating apparatus further comprises reset means which compulsorily resets the processing circuit when the apparatus is turned on. The reset means is provided, for example in the processing circuit to reset an input latch, which temporarily latches the musical-tone sample data sent from the processor, by means of hardware at the time when the power is turned on.

The processor starts running a predetermined program when the power is turned on, and initializes memories, registers and output latches for outputting the generated musical-tone sample data within the processor after a certain time lapses, and then the processor starts generating the musical-tone sample data.

Meanwhile, the hardware processing circuit externally connected to the processor starts operation independently of operation of the processor at the time when the power is turned on, and the input latch in the processing circuit is compulsorily reset at the same time when the power is turned on.

Therefore, even if the processing circuit starts operation before the processor outputs the musical-tone sample data, the processing circuit does not output any undesired musical-tone signals, suppressing noise.

The fourth themes of the present invention are to provide a musical-tone signal generating apparatus which executes musical-tone controlling processes such as a noise shaping process, including a delay process to be executed on an input musical-tone signal.

According to the fourth aspect of the present invention, there is provided a musical-tone signal generating apparatus which comprises null input-signal discriminating means for discriminating whether or not an input musical-tone signal to be subjected to a musical-tone controlling process has become null, and reset means for compulsorily resetting contents of a delay section such as a latch for executing a delay process on the musical-tone signal when the null input-signal discriminating means judges that the musical-tone signal has become null.

The null input-signal discriminating means discriminates, for example, that an amplitude envelope of the input musical-tone signal has become null. The null input-signal discriminating means also discriminates that an amplitude of the input musical-tone signal keeps null for more than a predetermined time duration. Further, the null input-signal discriminating means discriminates that a difference between amplitudes of the input musical-tone signal has become null. The null input-signal discriminating means may discriminate that the difference between amplitudes of the input musical-tone signal remains null for more than a predetermined time duration.

In the above musical-tone signal generating apparatus, the reset means compulsorily resets contents of the delay section such as the latch for executing delay process on the musical-tone signal when the null input-signal discriminating means discriminates that the musical-tone signal has been subjected to the noise shaping process and has become null. The musical-tone signal generating apparatus therefore can suppress undesired noise components which might be generated based on a musical-tone signal previously remaining in the delay section.

According to the fifth aspect of the present invention, there is provided another musical-tone signal generating apparatus which comprises null input-signal discriminating means for discriminating whether or not an input musical-tone signal to be subjected to a musical-tone controlling process has become null, and null output-signal discriminating means for discriminating whether or not a musical-tone signal output from a musical-tone controlling process has become null, and further reset means for compulsorily resetting contents of a delay section such as a latch for executing a delay process on the musical-tone signal, when the null output-signal discriminating means judges that an output musical-tone signal has become null after the null input-signal discriminating means judges that an input musical-tone signal has become null.

The null output-signal discriminating means discriminates, for example, whether or not an amplitude envelope of an output musical-tone signal has become null. The null output-signal discriminating means also discriminates whether or not an amplitude of the output musical-tone signal keeps null for more than a predetermined time duration. Further, the null output-signal discriminating means discriminates whether or not a difference between amplitudes of the output musical-tone signal has become null. The null output-signal discriminating means may discriminate whether or not the difference between amplitudes of the output musical-tone signal remains null for more than a predetermined time duration.

In the above musical-tone signal generating apparatus, the reset means compulsorily resets contents of the delay section such as the latch for executing a delay process on the musical-tone signal, when the null output-signal discriminating means judges that an output musical-tone signal has become null after the null input-signal discriminating means judges that an input musical-tone signal has been subjected to the noise shaping process and has become null. The musical-tone signal generating apparatus can suppress noise which might be generated when the contents of the delay section are reset before the output musical-tone signal has completely decreased.

In the apparatus according to the fourth or fifth aspect of the present invention, the null input-signal discriminating means can judge that the input musical-tone signal has become null, by discriminating whether or not the amplitude envelope of the input musical-tone signal has become null or the amplitude of the input musical-tone signal remains to be null for more than a predetermined time duration while the null output-signal discriminating means can judge that the output musical-tone signal has become null by discriminating whether or not the amplitude envelope of the output musical-tone signal has become null or the amplitude of the output musical-tone signal remains to be null for more than a predetermined time duration.

Further, the null input-signal discriminating means can judge that the input musical-tone signal has become null by discriminating whether or not the difference between the amplitudes of the input musical-tone signal has become null while the null output-signal discriminating means can judge that the output musical-tone signal has become null, by discriminating whether or not the variation in amplitude of the output musical-tone signal has become null. In these cases, even when the amplitude of the input or output musical-tone signal has become null or has become to a low D.C. level, the contents of the delay section can be reset or cleared.

BRIEF DESCRIPTION OF THE DRAWINGS

FIG. 7 is a view showing a memory area on the RAM for each sound channel;

FIG. 8 is a view showing buffer area on the RAM;

FIG. 29 is a view showing control clocks used in various processes executed by the arithmetic circuit;

DETAILED DESCRIPTION OF THE PREFERRED EMBODIMENTS

Now, preferred embodiments of a musical-tone signal generating apparatus according to the present invention will be described with reference to the accompanying drawings.

GENERAL STRUCTURE OF THE FIRST EMBODIMENT

Figure 1:
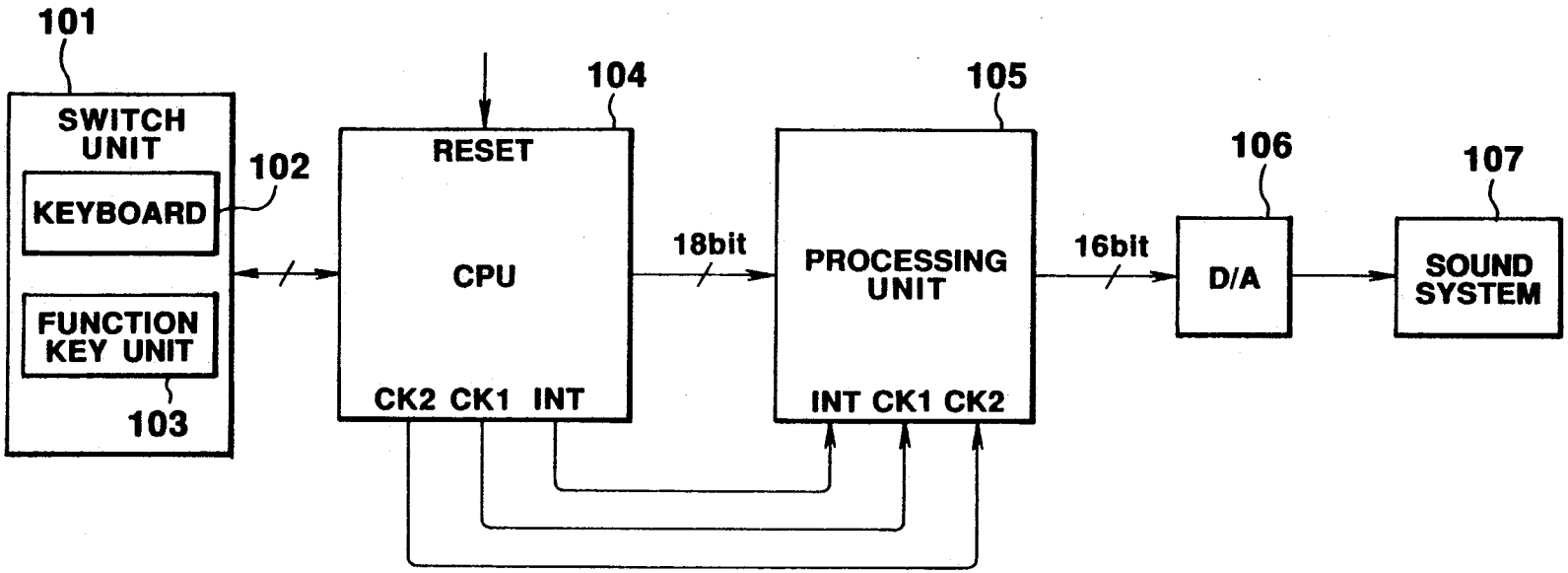
FIG. 1 is a view showing a whole structure of an embodiment of a musical-tone generating apparatus according to the present invention.

FIG. 1 is a view showing a whole structure of the first embodiment of the musical-tone signal generating apparatus of the present invention. As shown in FIG. 1, the embodiment of the musical-tone signal generating apparatus is schematically composed of CPU 104 for generating a musical-tone signal through a software process and a processing circuit for executing the other processes.

A switch unit 101 including a key board 102 and a function key unit 103 is an input operation unit of a musical instrument. Performance data input from the switch unit 101 is processed in CPU 104 and the processing circuit 105.

A musical-tone signal generated by the processing circuit 105 is supplied to a D/A convertor 106, being converted into an analog signal. The analog signal is smoothed by a low pass filter (not shown) and is audibly output from a sound system 107.

Figure 2:
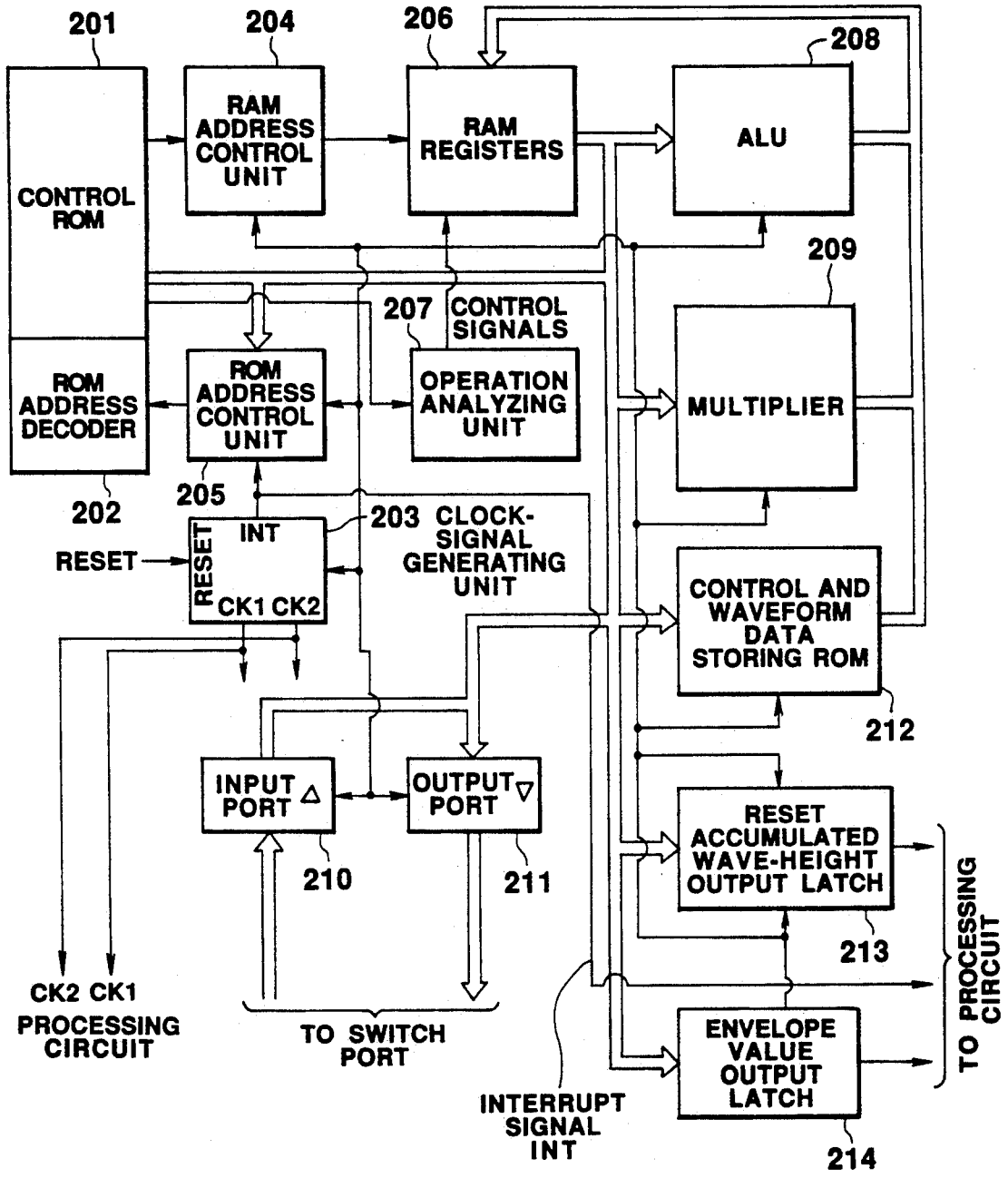
FIG. 2 is a block diagram showing an internal structure of the CPU.

FIG. 2 is a block diagram showing an internal structure of CPU 104.

A control and waveform data storing ROM 212 stores musical-tone control parameters such as target values of envelope values to be described later, musical-tone difference waveform data and quantized data in an adaptive difference pulse code modulation (ADPCM). Successively analyzing contents of a program stored in a control ROM 201, an operation analyzing unit 207 accesses the respective data on the control and waveform data storing ROM 212 to perform a sound-source process by means of software.

The control ROM 201 stores a program for controlling a musical tone to be described later, and successively outputs program languages (commands) which are stored at addresses designated through ROM address decoder 202 from ROM address control unit 205. More specifically, language lengths of respective program languages are, for example, 28 bits, and a next address system is executed in which a part of a program language is input as a less significant part (address within page) of an address to be read out next to ROM address control unit 205. A CPU of a ordinary counter system may be used as CPU 104.

The operation analyzing unit 207 analyzes an operation code of a command output from the control ROM 201, and sends control signals to respective circuits to perform designated operations.

RAM address control unit 204 designates an address of a relevant register in RAM 206, when an operand of a command sent from the control ROM 201 designates a register. RAM 206 stores various buffers as well as various musical-tone control data for 8 channels, as will be described later.

ALU 208 performs an addition and subtraction and a logical operation, and a multiplier 209 performs a multiplication, based on an instruction of the operation analyzing unit 207, when a command from the control ROM 201 is an operation command.

A clock-signal generating unit 203 supplies an interrupt signal INT at predetermined intervals to ROM address control unit 205 and an input latch (2601 in FIG. 26) of an arithmetic circuit 2305 within a processing circuit 105 to be described later.

An input port 210 and an output port 211 are connected to the switch unit 101 of FIG. 1.

Various data read out from the control ROM 201 and RAM 206 are supplied via a bus to ROM address control unit 205, ALU 208, the multiplier 209, the control and waveform data storing ROM 212, an accumulated wave-height output latch 213, an envelope value output latch 214, the input port 210 and the output port 211. Output signals of ALU 208, the multiplier 209 and the control and waveform data storing ROM 212 are supplied to RAM 206 via the bus.

An accumulated wave height and an envelope value of one sample data of a musical-tone signal generated through the sound-source process are input via the bus to the accumulated wave-height output latch 213 and the envelope value output latch 214 respectively. When a sound-process complete signal is input to clock inputs of the accumulated wave-height output latch 213 and the envelope value output latch 214 from the operation analyzing unit 207, the accumulated wave heights and the envelope values of one sample data of a musical-tone signal are successively read out from RAM 206 onto the bus, and are successively latched in the accumulated waveform-height output latch 213 and the envelope value output latch 214.

Operation of CPU 104

General Operation of CPU 104

Now, general operation of CPU 104 of FIG. 1 will be described hereafter referring to the whole structure of the embodiment shown in FIG. 1.

Figure 3:
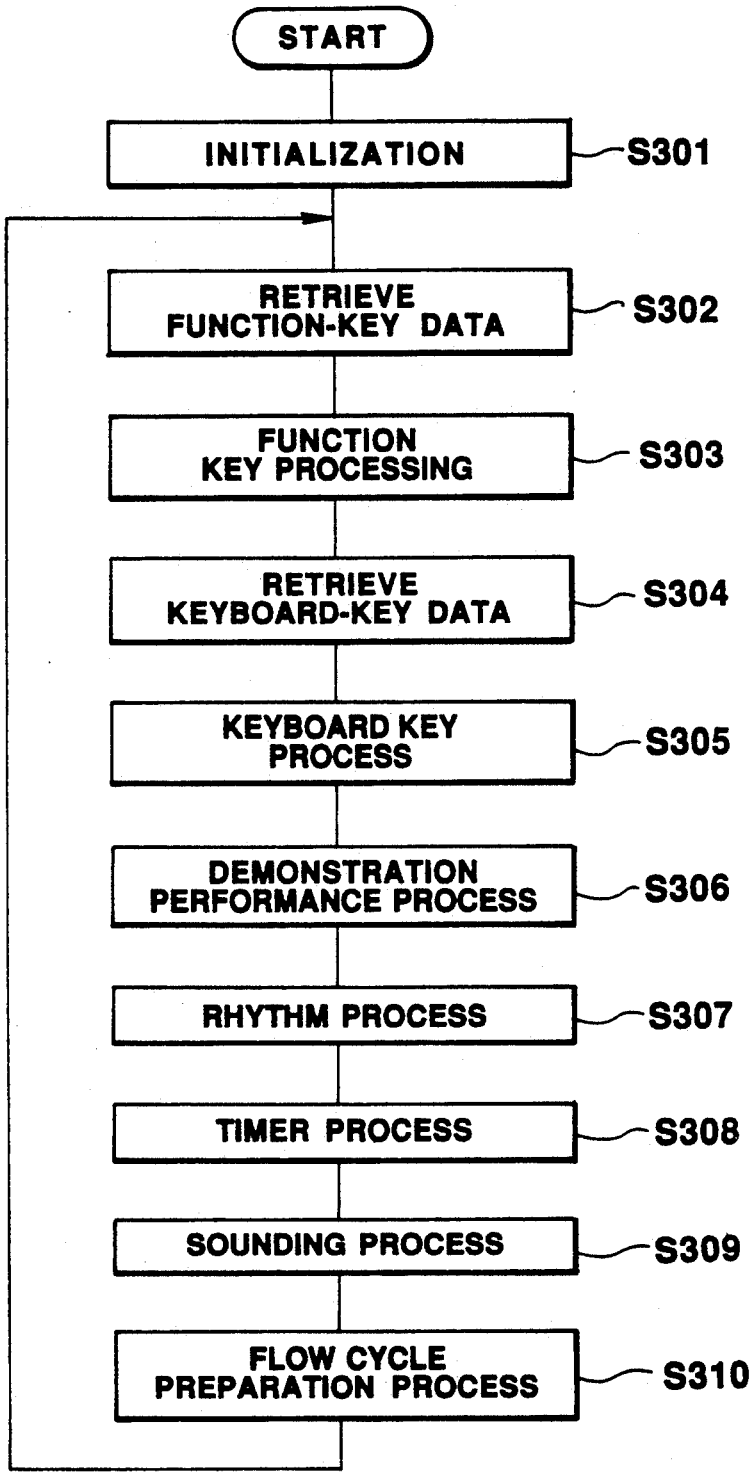
FIG. 3 is a main flow chart showing operation of the CPU.

In the present embodiment, CPU 104 repeatedly performs a series of processes at steps S302 through S310 in accordance with a main flow chart of FIG. 3, executing a sound-source process to generate musical-tone data.

CPU 104 executes the actual sound-source process when an interrupt service is entered. More specifically, an interrupt is caused at certain intervals while CPU 104 is executing a program in accordance with the main flow chart of FIG. 3. Then, CPU 104 executes a program of the sound-source process, generating a musical-tone signal of 8 channels. When the sound-source process is finished, musical-tone signals are accumulated for 8 channels, being output as an output musical-tone signal to the accumulated wave-height output latch 213 of FIG. 2. Then, CPU 104 returns from the interrupt service to the processes of the main flow chart. The above interrupt service is periodically executed in accordance with instructions from a hard timer within the clock-signal generating unit 203 of FIG. 2. The period at which the interrupt service is executed is equivalent to the sampling period at which musical-tone signals are output.

The general operation of CPU 104 has been described above. Now, detailed operation of CPU 104 will be described with reference to FIGS. 3 to 5.

The main flow chart of FIG. 3 illustrates a flow of processes other than the sound-source process which are executed by CPU 104 while no interrupt is caused by the clock-signal generating unit 203.

When the power is turned on, contents of RAM 206 within CPU 104 shown in FIG. 2 are initialized at step S301. Respective switches in the function key unit 103 of FIG. 1, which is externally connected to CPU 104, are scanned at step S302. States of the respective switches are sent through the input port 210 to a key buffer area of RAM 206. Upon completion of scanning keys, a function key whose state has been changed is detected, and a process of the relevant function is executed at step S303. For example, the number of a musical tone, the number of an envelope are set and number of rhythm is set, if a rhythm performance is to be effected.

Then, the states of depressed keys of the key board 102 are sent to the key buffer area of RAM 206 similarly to the above function key at step S304. When the keys are detected, a key assign process is executed at step S305.

When a demonstration performance key (not shown) of the function key 103 of FIG. 1 is depressed, demonstration performance data (sequencer data) are sequentially read out from the control and waveform data storing ROM 212 of FIG. 2, and the key assign process is executed at step S306. When a rhythm start key (not shown) of the function key unit 103 is depressed, rhythm data are sequentially read out from the control and waveform data storing ROM 212, and the key assign process is executed at step S307.

At step S308, a timer process is executed. More specifically, a time value of time data, which has been incremented through an interrupt timer process of step S402 to be described later, is judged, and the time data is compared with sequencer data for controlling times which are sequentially read out to control a demonstration performance, whereby a time control is effected for the demonstration performance of step S306 or is compared with rhythm data for controlling time which are read out to control a rhythm performance, whereby a time control is effected for the rhythm performance of step S306.

In a sounding process at step S309, a pitch envelope process is executed to apply an envelope to pitches of a musical tone to be subjected to a sounding process, and to set pitch data to a corresponding sound channel.

A flow cycle preparation process is executed at step S310. During the flow cycle preparation process, a state of a sounding channel of a note number corresponding to a key to be depressed in a keyboard key process is changed while a key is being depressed, or a state of a sounding channel of a note number corresponding to a released key in a keyboard key process is changed while no sound is produced.

Now, an interrupt service of FIG. 4 will be described.

Figure 4:
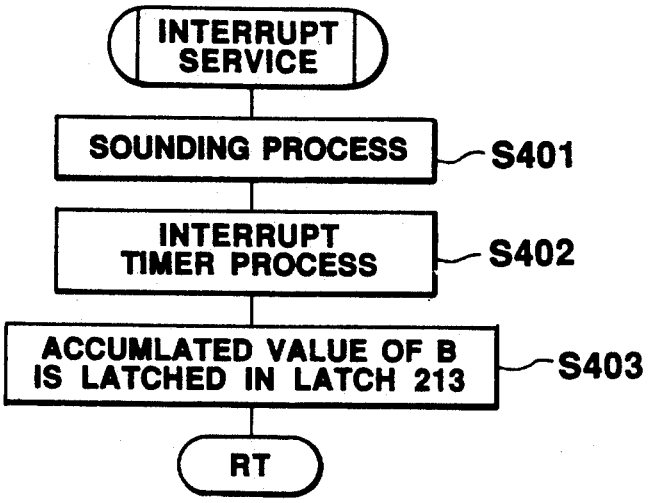
FIG. 4 is an operation flow chart of an interrupt process.

When an interrupt is entered by the clock-signal generating unit 203 to a program corresponding to the main flow chart of FIG. 3, execution of the program is halted and a program of the interrupt service of FIG. 4 starts running. The program of the interrupt service controls such that contents of registers which are written during execution of the program of the main flow chart of FIG. 3 are not re-written. A process therefore is not needed which is executed at the beginning and the end of the conventional interrupt service for allowing the registers to retire and comeback, whereby CPU 104 can move rapidly from the operation of the main flow chart of FIG. 3 to the interrupt service and vice versa.

Figure 5:
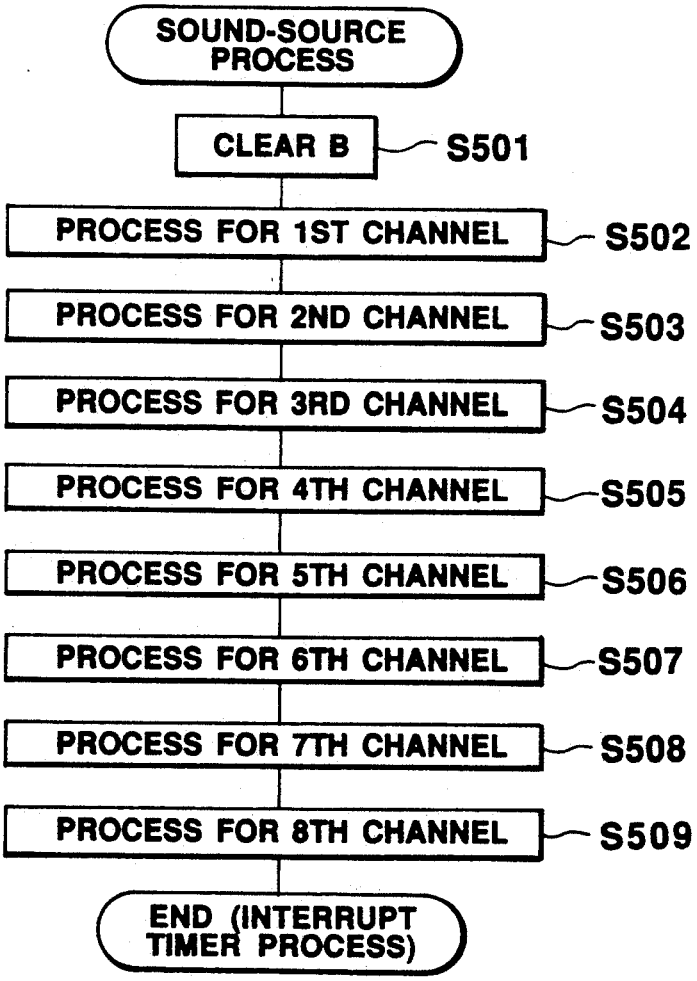
FIG. 5 is an operation flow chart of a sound-source process.

In the interrupt service, the sound-source process starts at step S401. The details of the sound-source process are shown in FIG. 5. Accumulated musical-tone signal data for 8 channels are obtained in a buffer B in RAM 206 of FIG. 2 through the sound-source process.

At step S402, an interrupt timer process is executed. Since the interrupt service of FIG. 4 is executed every predetermined number of sampling periods, a value of time data (not shown) in RAM 206 of FIG. 2 is incremented accordingly. The time data represents a time lapse. As described above, the time data obtained thus is used in the timer process at step S308 of the main flow chart of FIG. 3 for time controlling.

An accumulated wave height value in the above buffer area is latched in the accumulated wave-height output latch 213 of FIG. 2.

Now, the operation of the sound-source process, which is executed at step S401 of the interrupt service, will be described referring to the flow chart of FIG. 5.

An area of RAM 206 for adding waveform data is cleared at step S501. The sound-source processes are executed for respective channels of a sounding channel at steps S502 through S509. Finally, when the sound-source process for the 8th channel is finished, waveform data accumulated for 8 channels is obtained in a buffer area B. The details of the processes will be described later.

Figure 6:
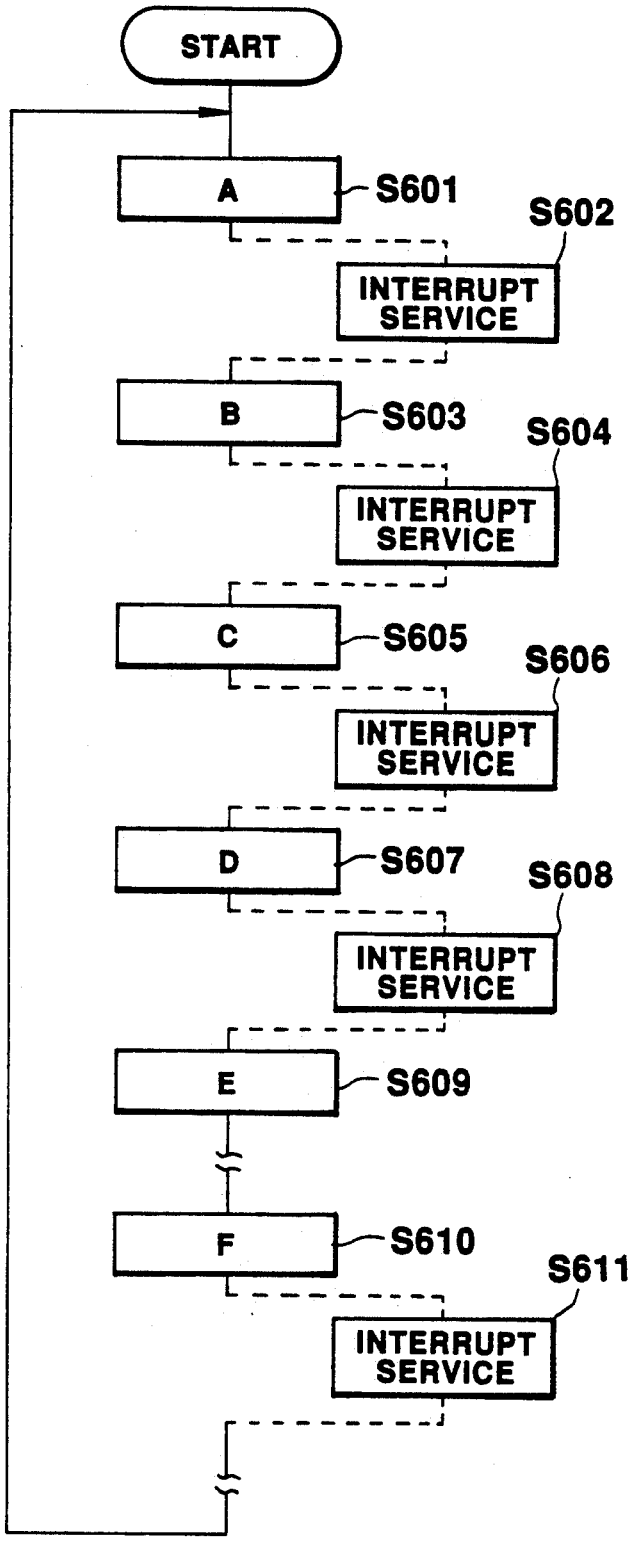
FIG. 6 is a conceptional view showing a relationship between the main flow chart of operation of the CPU and the interrupt process.

FIG. 6 is a conceptional chart showing a relationship between the processes of the flow chart of FIG. 3 and those of the flow chart of FIG. 4. At step S601, a process A is executed. For example, the process A corresponds to "the function-key process" or "the keyboard-key process" of the main flow chart shown in FIG. 3. Then, the interrupt service is entered, starting the sound-source process at step S602. A musical-tone signal including one-sampling signal for 8 channels is obtained through the sound-source process, and is output to the accumulated wave-height output latch 213. And then CPU 104 returns to a process B of the main flow chart. Similar operation is repeatedly executed at steps S604 to S611, whereby the sound-source process is performed for all the sound channels. The operation is executed while musical tones are being audibly output.

Data Structure in Sound-Source Process

Now, the sound-source process, which is to be executed at step S401 of FIG. 4, will be described more specifically.

In the present embodiment, CPU 104 executes the sound-source process for 8 sound channels, as described above. Data for 8 channels to be processed in the sound-source process have a data format as illustrated in FIG. 7, and are set respectively in areas which are prepared in RAM 206 of FIG. 2 for 8 sound channels.

In RAM 206, a buffer B as shown in FIG. 8 for temporarily holding accumulated waveforms is prepared.

Figure 9:
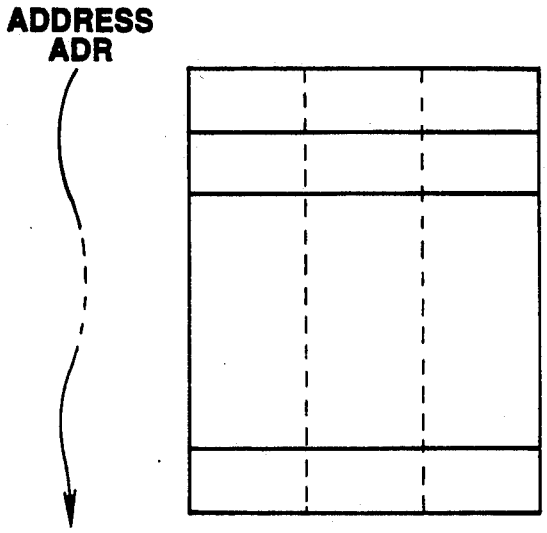
FIG. 9 is a view showing a data format of quantized data on a control and waveform data storing ROM.

Various control data used in the sound-source process based on the ADPCM system are stored in respective sound channel areas of FIG. 9. In FIG. 7, a symbol A represents an address designated when an adaptive quantized difference data (which will be described later) is read out during the sound-source process. A symbol Ai stands for an integer portion of a current address that corresponds directly to an address where adaptive quantized difference data of the control an waveform data storing ROM 212 of FIG. 2 is stored. A symbol Af stands for a decimal portion of the current address, which is used for interpolation of an inverse quantized difference value read out from the above ROM 212. Symbols Pi and Pf represent an integer portion and a decimal portion of pitch data respectively.

For example, Pi=1, Pf=0 represent a pitch of an original sound, Pi TM 2, Pf=0 represent a pitch which is higher by one octave and Pi=0, Pf=0 represent a pitch which is lower by one octave. Other various control data will be described in detail when the ADPCM system is described later.

Control data such as pitch data, envelope data, required in the sound-source process are set in corresponding sound-channel areas respectively, when CPU 104 executes processes in accordance with the main flow chart of FIG. 3. In the sound-source processes which are executed for respective sound-channels of FIG. 5 during the interrupt services of FIG. 4, the various control data set in the sound channel areas are used to generate musical tones. In this manner, data transfer between the program of the main flow-chart process and the program of sound-source process is executed through control data (musical-tone generating data) in the sound-channels area of RAM 206. When one program is running, the sound-channel areas may be accessed independently of how the other program is running and vice versa. The programs therefore may be incorporated as substantially independent modules respectively, and may be written as a simple and effective program structure.

The control and waveform data storing ROM 212 stores adaptive quantized difference data of a data format (not shown) as well as quantized data of a format shown in FIG. 9. As will be described later, the quantized data is used as control data for inverse quantizing adaptive quantized difference data which are read out from the control and waveform data storing ROM 212. Further, the control and waveform data storing ROM 212 stores control data for generating musical tones of respective tone colors. When a player or user of the present apparatus sets tone color, the above control data are transferred from the control and waveform data storing ROM 212 to the sound-channel areas of RAM 206 to be set therein.

Principle of Sound-Source Process depending on ADPCM system

Now, the sound-source process depending on the ADPCM system or a sound-source process (either of processes at steps S502 through S509) for one of the sound-channels of FIG. 5 will be described. The operation analyzing unit 207 of CPU 104 interprets and performs the program for the sound-source process, stored in the control ROM 201, executing the sound-source process. Hereafter, unless otherwise described, all processes are to be executed with this premise.

At first, an operational principle of the ADPCM system will be described in brief.

Figure 10:
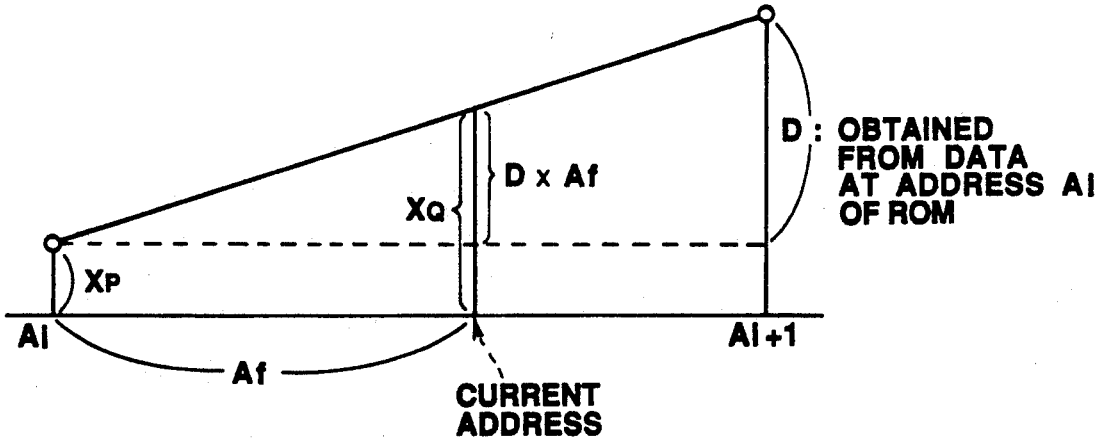
FIG. 10 is a view schematically illustrating a principle for obtaining an interpolated value Xq using a difference value D and a present address Af on the ADPC system.

In FIG. 10, sample data Xp corresponding to an address Ai of the control and waveform data storing ROM 212 of FIG. 2 is obtained from a difference value different from a sample data corresponding to an address (Ai−1) (not shown) preceding the address Ai.

At the address Ai of the control and waveform data storing ROM 212, adaptive quantized difference data is written for obtaining a difference value D from the following sample data. The difference value D can be obtained from the adaptive quantized difference data. A sample data at the following address is obtained from the expression: Xp+D, and the newly obtained data Xp+D is substituted as a new sample data Xp.

If the current address is Af as shown in FIG. 10, the sample data corresponding to the current address Af is obtained from the expression: Xp +D x Af.

As described above, in the ADPCM system, adaptive quantized difference data for obtaining a difference value D from a sample data of the following address is read out from the control and waveform data storing ROM 212 of FIG. 2, and the difference value D is calculated, added to the current data. Then, the following sample data is obtained, and in the manner waveform data are sequentially generated.

When a waveform signal such as a sound and a musical tone is quantized, in which a difference value between adjacent data is small, the ADPCM system will be a useful means because the ADPCM system allows data to be quantized with a few number of bits compared with a conventional PCM system.

The ADPCM system employs a fine principle of an adaptive quantization, as will be described later.

Now, we assume that, when difference values of a musical-tone signal are stored in a memory, n bits of quantizating bits are required for quantizing a difference value of a maximum amplitude ±E with a given S/N ratio. If only a data capacity of m bits less than n bits is assigned to one sample data due to a limited capacity of a memory, a difference value per one sample has to be managed to be quantized with m bits of quantizing bits.

For that purpose, a range of the amplitude (from −E to +E) is divided by $2^m$, resulting in a wider range of quantization with poor S/N ratio.

In the ADPCM system, when a difference value of a musical-tone signal is stored in a memory, an absolute amplitude value which can be expressed by m bits with a given S/N ratio defines a range of |±e| smaller than |±E|. A difference value, an absolute value of whose amplitude is larger than |±e|, is divided by a normalizing coefficient larger than 1, being compressed so as to fall into the range. Then, the difference value is quantized by m bits, being stored in the memory. As a result, the bit number per one sample data required for quantization can be reduced with a given S/N ratio. The process described above is called an adaptive quantization.

In order to reproduce the original difference value from difference data adaptive-quantized as described above, the normalizing coefficient by which sample data was normalized is stored together with the sample data. When the adaptive quantized difference data is read out from the memory, a relevant normalizing coefficient is simultaneously read out. The adaptive quantized difference data is multiplied by the normalizing coefficient, whereby the original difference value is obtained. This process is called an inverse-adaptive quantization.

When the normalizing coefficients for respective sample data are stored, a memory capacity is required as much as required when a difference value of an amplitude range ±E is quantized with n bits. Data compression therefore is not realized.

Specific operation of the sound-source process by means of the ADPCM system, which can suppress an increase of memory capacity will be described hereafter. <Specific Operation of Sound-Source Process by means of ADPCM system>.

An amplitude of difference value of a musical-tone signal does not vary abruptly within some time duration corresponding to a continuous 8 samples. So let us assume that difference values for a continuous 8 samples are adaptive-normalized with the same normalizing coefficient to store the difference values in the memory. The normalizing coefficient is also quantized with several bits such that the normalizing coefficient itself varies at not so fine steps.

More specifically, the normalizing coefficient is expressed with 3 bits so that a value of the normalizing coefficient varies at 8 steps. The normalizing coefficient therefore may be quantized every 8 samples with 3 bit data to be stored in the memory, allowing data compression. Hereafter, the above normalizing coefficient will be referred to as quantized data.

Figure 11:
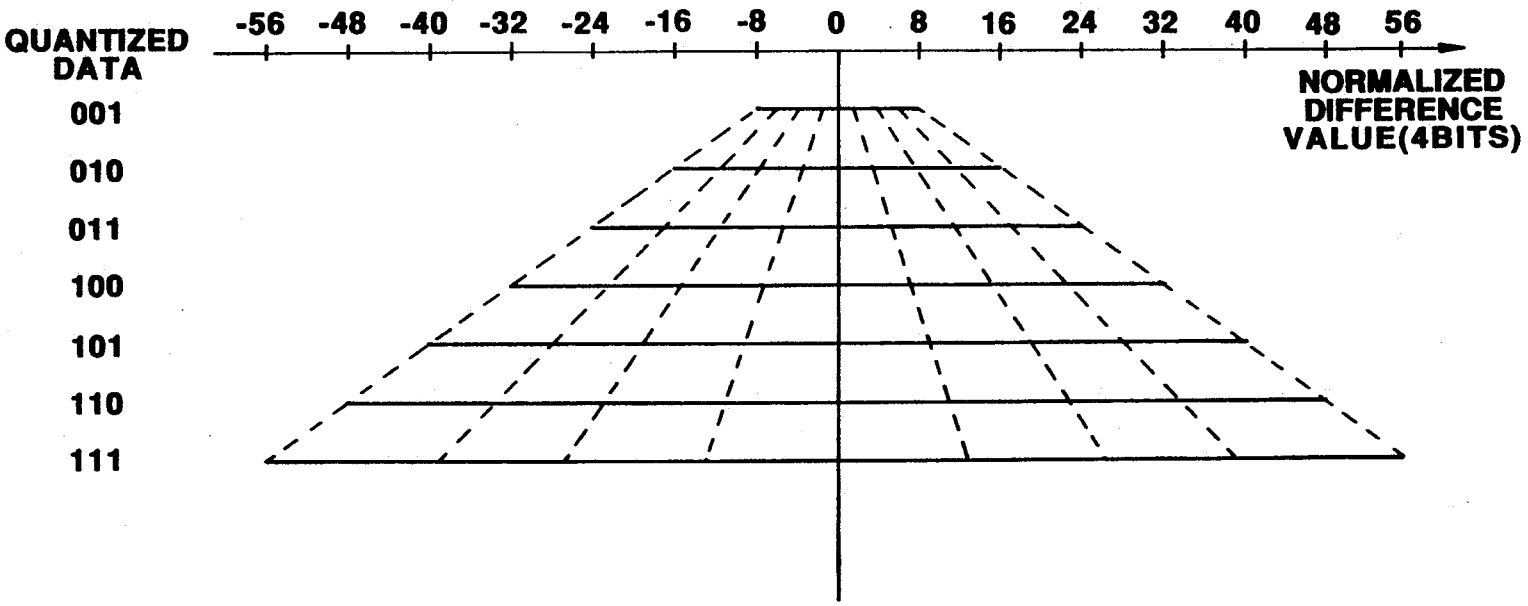
FIG. 11 is a view showing a principle of an adaptive quantization.
Figure 12:
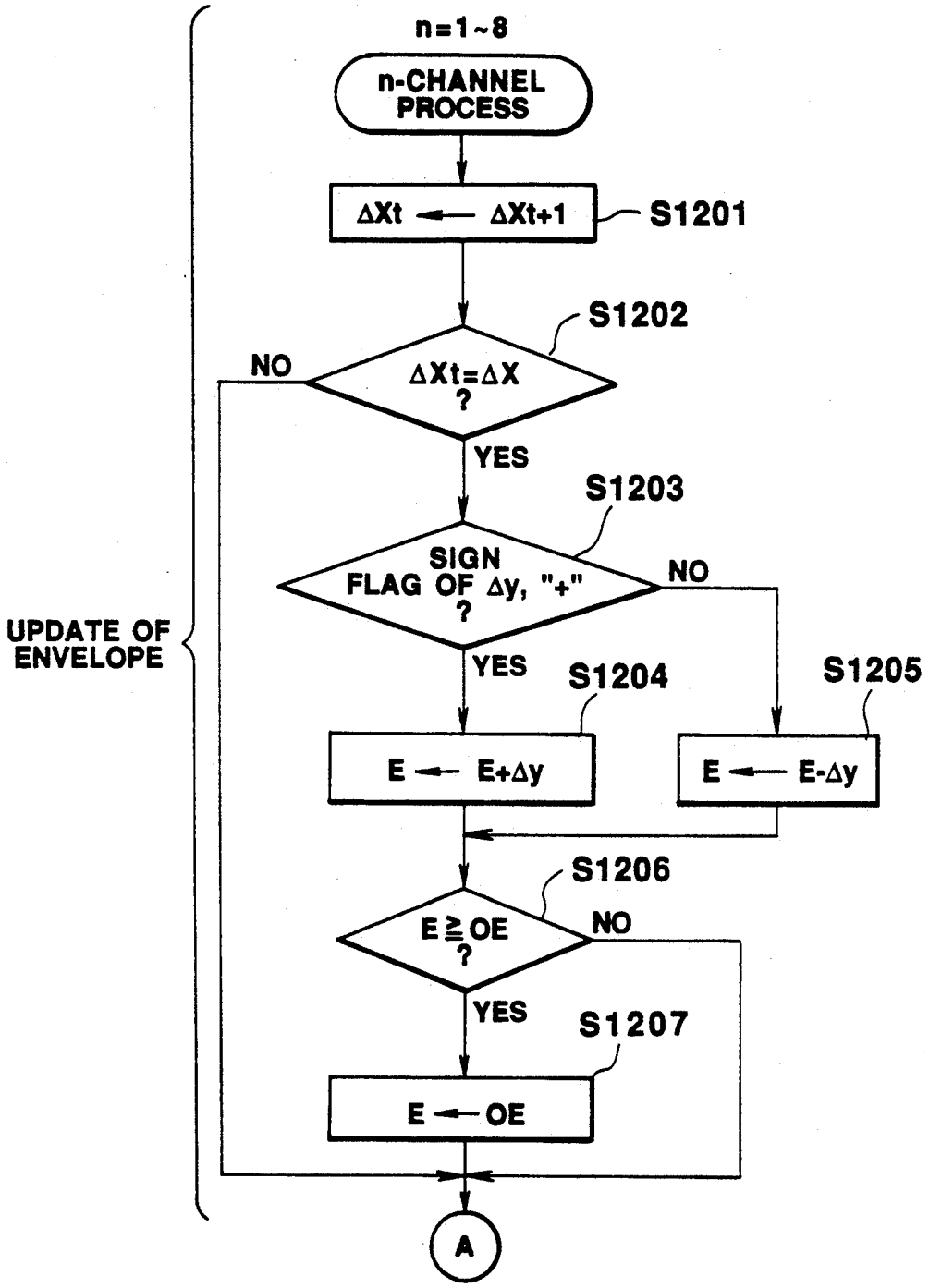
FIG. 12 is an operation flow chart (No. 1) of the sound source process of the ADPC system.
Figure 13:
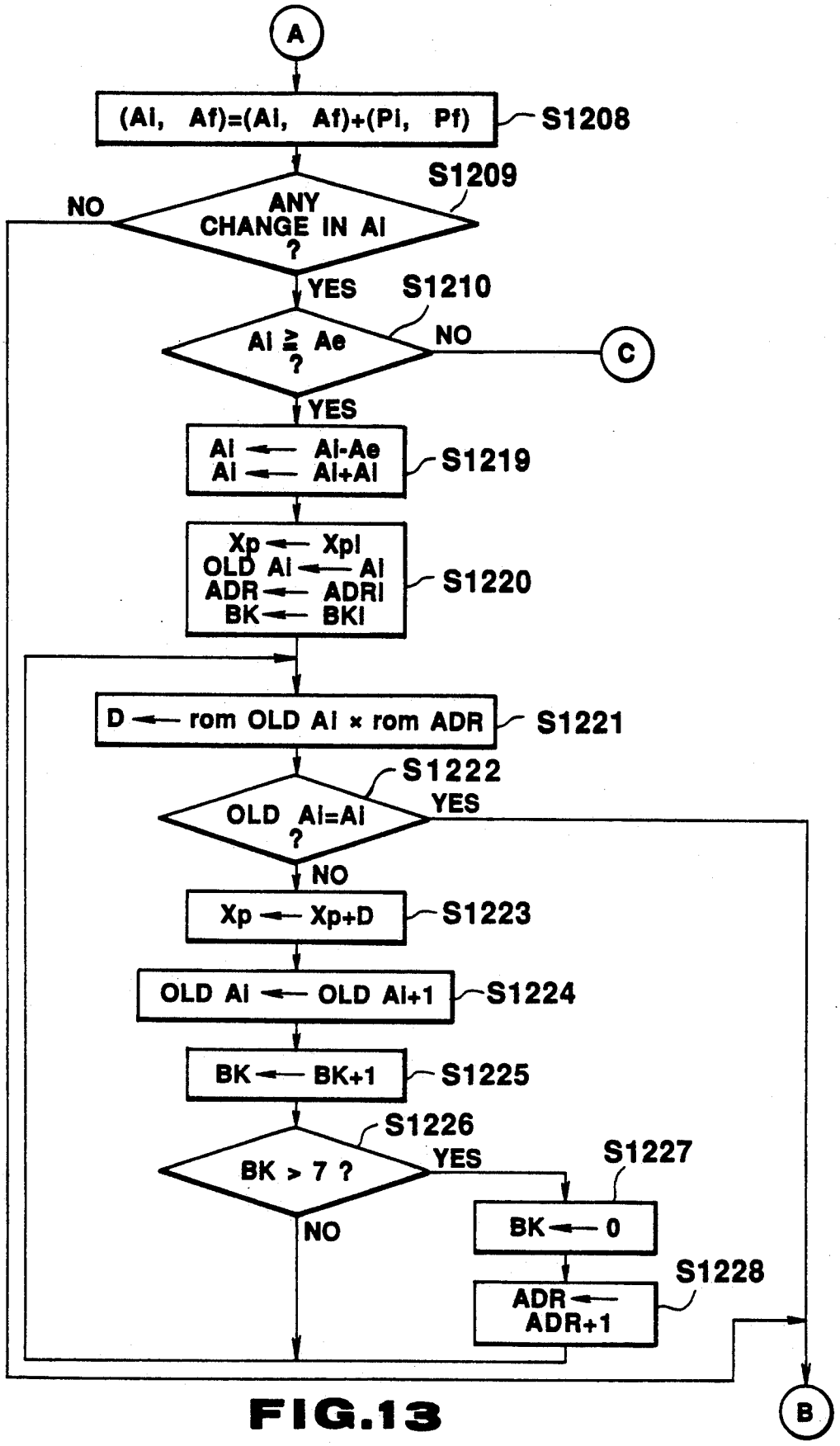
FIG. 13 is an operation flow chart (No. 2) of the sound source process of the ADPC system.
Figure 14:
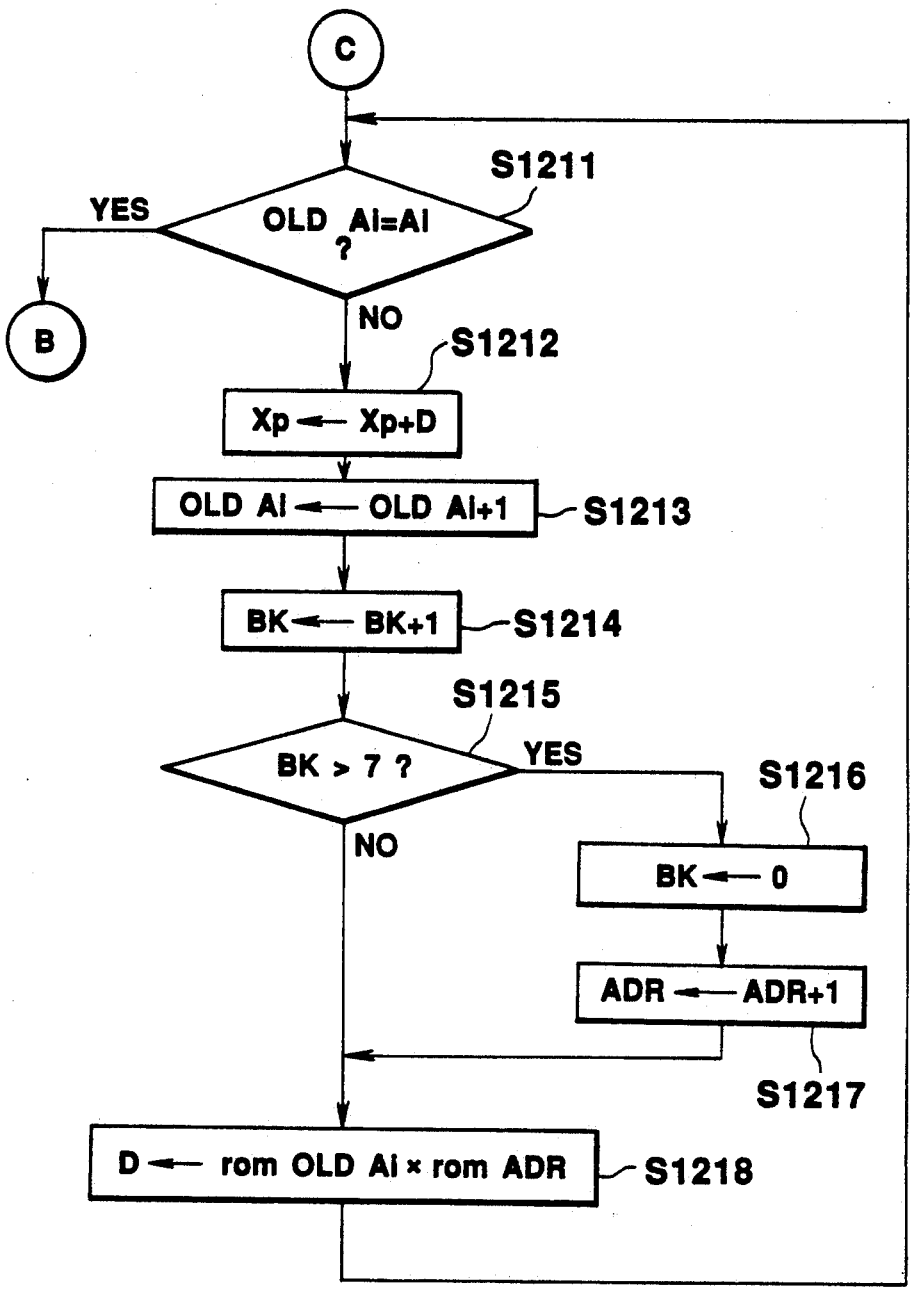
FIG. 14 is an operation flow chart (No. 3) of the sound source process of the ADPC system.
Figure 15:
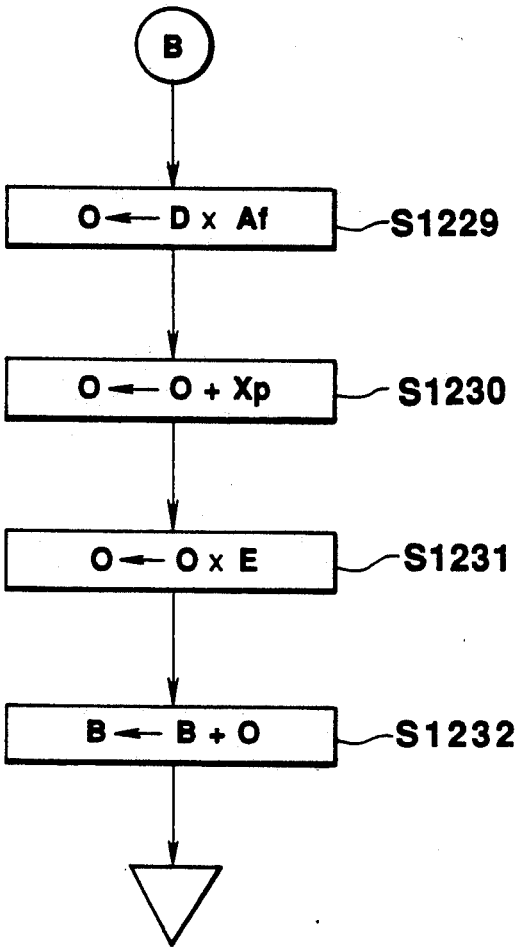
FIG. 15 is an operation flow chart (No. 4) of the sound source process of ADPC system.

The above described principle will be described with reference to FIG. 11. In FIG. 11, ±E is ±56.4, ±e is ±8, and a quantization range is 1. Hence, since a range of ±8 is quantized with 16 levels, quantized bit number will be 4 bits and quantized data be 3 bits, when the difference value is adaptive-quantized. When the difference values are adaptive-quantized, the original difference values are divided by a coefficient corresponding to the quantized data, being compressed into a range of ±8.

In FIG. 11, when the original difference value is within a range of ±8, the original difference value is divided by a coefficient 1 which is designated by quantized data "001", that is, no data compression is effected. When the original difference value is within a range between ±8 and ±16, the original difference value is divided by a coefficient 2 which is designated by quantized data "010". Similarly, when the original difference value is within a maximum range between ±32 and ±64, the original difference value is divided by a coefficient 8 which is designated by quantized data "111". Difference data which have been data-compressed and quantized with 4 bits are stored in the control and waveform data storing ROM 212 of FIG. 2 and simultaneously quantized data of 3 bits are stored in ROM 212 data by data for respective 8 samples of difference values.

Now, specific operation of the sound-source process by means of the ADPCM system will be described with reference to the flow charts of FIGS. 12 to 15. Respective variables used in processes of the flow charts are secured with the formats shown in FIG. 7 in the corresponding sound channel areas of RAM 206 of CPU 104.

The sound-source process shown in FIGS. 12 to 15 comprises mostly envelope process (steps S1201 through S1207) and waveform process (steps S1208 through S1232).

The envelope process will be described before the waveform process based on the principle of ADPCM system of FIGS. 10 and 11.

Figure 16:
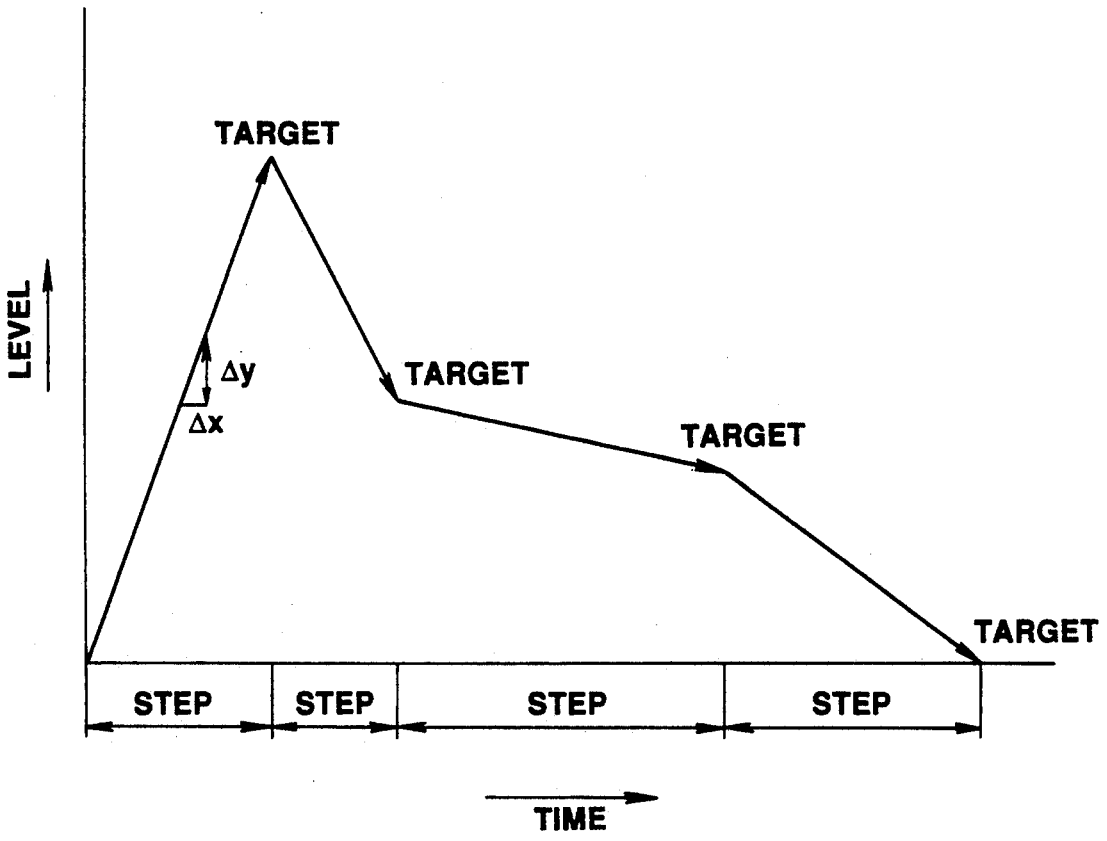
FIG. 16 is a view illustrating envelope features.

FIG. 16 is a view showing an envelope generated through the envelope process. As will be described later, at step S1231, a musical-tone signal output 0 is multiplied by an envelope value E generated through processes at steps S1201 to S1207 of FIG. 12, applying an envelope to sample data of musical-tone signals.

The envelopes to be applied to respective musical-tone signal data consist of several segments. An example of an envelope consisting of four segments is shown in FIG. 16. ΔX stands for a sampling cycle of the envelope while ΔY stands for an increment of the envelope.

At steps S1201 to S1207 of the envelope process, an envelope value E is calculated every number of sampling timings and it is judged whether or not the calculated envelope value E has reached a target envelope value OE of a segment. When the envelope value E has reached the target value OE, it is detected in the sounding process at step S309 of the main flow chart of FIG. 3 that the envelope value E has reached the target value OE. Then, data (ΔX, ΔY and a target envelope value) for the following segment of the envelope are read out from the control and waveform data storing ROM 212 of FIG. 2 and are set to the corresponding sound channel area (see FIG. 7) of RAM of FIG. 2.

More specifically, at step S1201, a timer value ΔXt is incremented every number of interrupt timings to be compared with an arithmetic period ΔX of the envelope. Then, it is judged at step S1202 whether or not ΔX has coincided with ΔXt.

If not, the envelope process is not effected.

When it is judged at step S1202 that ΔX has coincided with ΔXt, a sign bit of the increment ΔY of the envelope is discriminated at step S1203.

When it is judged at step S1203 that the sign bit of the increment ΔY is positive, i.e., the result of the judgement at step S1203 is YES, the envelope is increasing. Then, at step S1204, the increment ΔY is added to the current envelope value E.

On the contrary, when the sign bit of the increment ΔY is negative, and the result of the judgement at step S1203 is NO, the envelope is decreasing. Then, at step S1205, the increment ΔY is subtracted from the current envelope value E.

Thereafter, it is judged at step S1206 whether or not a current envelope value E has reached or exceeded the target envelope value OE. When the current envelope value E has reached or exceeded the target envelope value OE, the current envelope value is replaced with the target envelope value OE.

In the sounding process at step S309 of the main flow chart shown in FIG. 3, it is recognized that the current envelope value has been replaced with the target envelope value 0E, and then data for the following segment of the envelope are set to RAM 206. When it is recognized in the sounding process that the current envelope value E is 0, it is also recognized the sounding process has been finished.

Now, the waveform process at steps S1208 to S1232 based on the principle of the ADPCM system of FIGS. 10 and 11 will be described.

Let us assume that, among addresses of the control and waveform data storing ROM 212 where adaptive quantized difference data are stored, the address where data to be processed i n the present process is stored is designated by (Ai, Af) of FIG. 7.

Pitch data (Pi, Pf) is added to the current address (Ai, Af) at step S1208. The pitch data corresponds to the key number of a depressed key of the key board 102 of FIG. 1.

It is judged at step S1209 whether or not any change in the integer portion Ai of an added address has been found. If the result of the judgement is NO, an interpolated data value 0 corresponding to the decimal portion Af of the address is calculated at step S1229 through an arithmetic process D×Af using the difference value D at the address Ai of FIG. 10. The difference value D has been previously obtained through the sound-source process at a previous interrupt timing (see steps S1218 and S1221 to be described later).

Then, sample data Xp corresponding to the integer portion Ai of the address is added to the interpolated data value 0, and thus a new sample data 0 (Xq of FIG. 10) corresponding the current address (Ai, Af) is obtained at step S1230.

The sample data 0 is multiplied by the envelope value E obtained in the previous envelope process at step S1231, and the content of the resultant product 0 is accumulated at step S1232 on the waveform data buffer B (FIG. 8) in RAM 206 of FIG. 2. Musical-tone signal-outputs generated through the sound-source process for other sound channels are accumulated in the buffer B, and finally musical-tone signal data of one sample is generated as accumulated data of 8 channels.

Then, operation returns to the process of the main flow of FIG. 3, and the interrupt is caused again at the following sampling timing, and wherein the sound-source process of FIGS. 12 to 15 will be executed and pitch data (Pi, Pf) is added to the current address (Ai, Af) at step S1208.

The above operation will be repeatedly performed until a change in the integer portion Ai of the address is found. During the performance of operation, the sample data Xp and the difference value D are not updated, and only the interpolated data 0 is updated in accordance with integer portion Af of the address, whereby a new sample data Xq is obtained every update of the sample data.

If the integer portion Ai of the current address has changed at step S1209 as a result of addition of the pitch data (Pi, Pf) to the current address (Ai, Af), it is judged at step S1210 whether or not the address Ai has reached or exceeded an end address Ae.

If the result of judgement is NO, sample data corresponding to the integer portion Ai of the current address is calculated in a loop process at steps S1211 to S1218. In other words, a value of the integer portion Ai of the current address before the integer portion Ai changes is stored in a variable of an old Ai (FIG. 7). This process is realized when processes at steps S1213 to S1224 are repeatedly executed.

The value of the old Ai is sequentially incremented at step S1218 while adaptive quantized difference data designated by the old Ai is read out from the control and waveform data storing ROM 212 of FIG. 2 at step S1218, whereby difference value D is calculated through the reverse quantization process. In the reverse quantization process, as described above, adaptive quantized difference waveform data is multiplied by quantized data, and wherein the quantized data is read out as data designated by quantized data current-address ADR from the control and waveform data storing ROM 212 (FIG. 11).

As described above, the quantized data correspond to every 8 samples of difference values, respectively. A variable or a within-block counter BK is prepared (FIG. 7), and the within-block counter BK is sequentially incremented from the initial value 0 at step S1214. At step S1215, it is judged if 8 samples has been obtained by judging whether or not the value of counter BK has exceeded a value 7. When the value of counter BK exceeds, the value of the counter BK is reset to the initial value 0 again at step S1216, and the quantized data current address ADR is advanced by 1 at step S1217.

Then a difference value D is calculated at step S1218 from a relevant quantized data which is read out in accordance with the quantized data current address ADR. Calculated difference values D are sequentially accumulated in the sample data Xp.

The above processes are repeatedly executed, and at the time when a value of the old integer portion Ai of the current address comes to the integer portion Ai of the current address, the sample data Xp will have a value corresponding to the integer portion Ai of the current address which has changed.

When the sample data Xp corresponding to the integer portion Ai of the current address is obtained, the result of the judgement at step S1211 will be YES, and the operation moves to the above described arithmetic process of step S1229 for calculating an interpolated value.

The above sound-source process will be executed every number of interrupt timings until the result of the judgement at step S1210 will be YES, and then the operation advances to the following loop process.

Addresses (Ai–Ae) exceeding the end address Ae are added to a loop address Al, and the obtained address will be a new integer portion Ai of the current address at step S1219.

As the address advances from the loop address Al, calculation and accumulation of a difference value D are successively effected for several times, whereby sample data Xp corresponding to a new integer portion of the current address is calculated.

In the initial setting, a previously set value of a sample data Xp1 of the loop address Al is set to the sample data Xp and a value of the loop address Al is set to the old address Ai.

Further, values of the quantized data current address ADR and the within-block counter BK are set as corresponding values ADR1 and BK1 respectively at step S1220.

Respective values of A1, Xp1, ADR1 and Bk1 are previously read out from the control and waveform data storing ROM 212 and are transferred to sound channel areas of RAM 206 (See FIG. 7). These data may be set by the player, using a suitable means (not shown).

Thereafter, processes at steps S1221 through S1228 are repeatedly executed.

As a value of the old Ai is sequentially incremented at step S1224, an adaptive quantized difference data designated by the old Ai is read out from the control and waveform data storing ROM 212 of FIG. 2, and a difference value D is calculated through the inverse quantization process.

Similarly in the process at step 1218, quantized data is read out from the address designated by quantized data current address ADR in the control and waveform data storing ROM 212, and adaptive quantized difference data is multiplied by the read out quantized data, whereby a difference value D is calculated.

Similarly, the quantized data current address ADR is updated in the processes at steps S1225 to S1228, and the difference values D are sequentially accumulated to the sample data Xp at step S1223.

The above processes are repeatedly executed, and at the time when a value of the old integer portion Ai of the current address comes to the integer portion Ai of the current address, the sample data Xp will have a value corresponding to a new integer portion Ai of the current address subjected to the loop process.

When the sample data Xp corresponding to a new integer portion Ai of the current address is obtained in the above manner, the result of the judgement at step S1222 will be YES, and the operation moves to the above described arithmetic process of step S1229 for calculating an interpolated value.

As has been described above, waveform data for one sound channel based on the ADPCM system are obtained as an output 0 (see FIG. 7) of the sound channel area of RAM 206 of FIG. 2, and, as described above, the output 0 is accumulated to the waveform data buffer B (see FIG. 8) at step S1232. Musical-tone signal-outputs generated through the sound-source process at steps S502 to S509 of FIG. 5 for other sound channels are accumulated in the buffer B, and finally musical-tone signal data for one sample is generated as accumulated data of 8 channels.

In the present embodiment, musical-tone data has an accuracy of 15 bits, which is obtained as an output 0 through the sound-source process based on the ADPCM system for one sound channel. Accordingly, musical-tone data which consists of accumulated data for 8 channels and is obtained in the waveform data buffer B has an accuracy of 18 bits, which is 8 times 15 bits. An accumulated waveform-height value in the waveform data buffer B is latched in the accumulated wave-height output latch 213. In consequence, the accumulated wave-height output latch 213 outputs musical-tone sample data of 18 bits.

Principle of Operation of Processing Circuit

Now, operation of the processing circuit 105 of FIG. 1 will be described. The processing circuit 105 executes signal processes of an over sampling process, a noise shaping process and a dither process. Principles of operations of these signal processes are described before a specific structure and operation of the processing circuit 105 are explained.

Principle of Over Sampling Process

Now, the principle of the over sampling process will be described.

Figure 17:
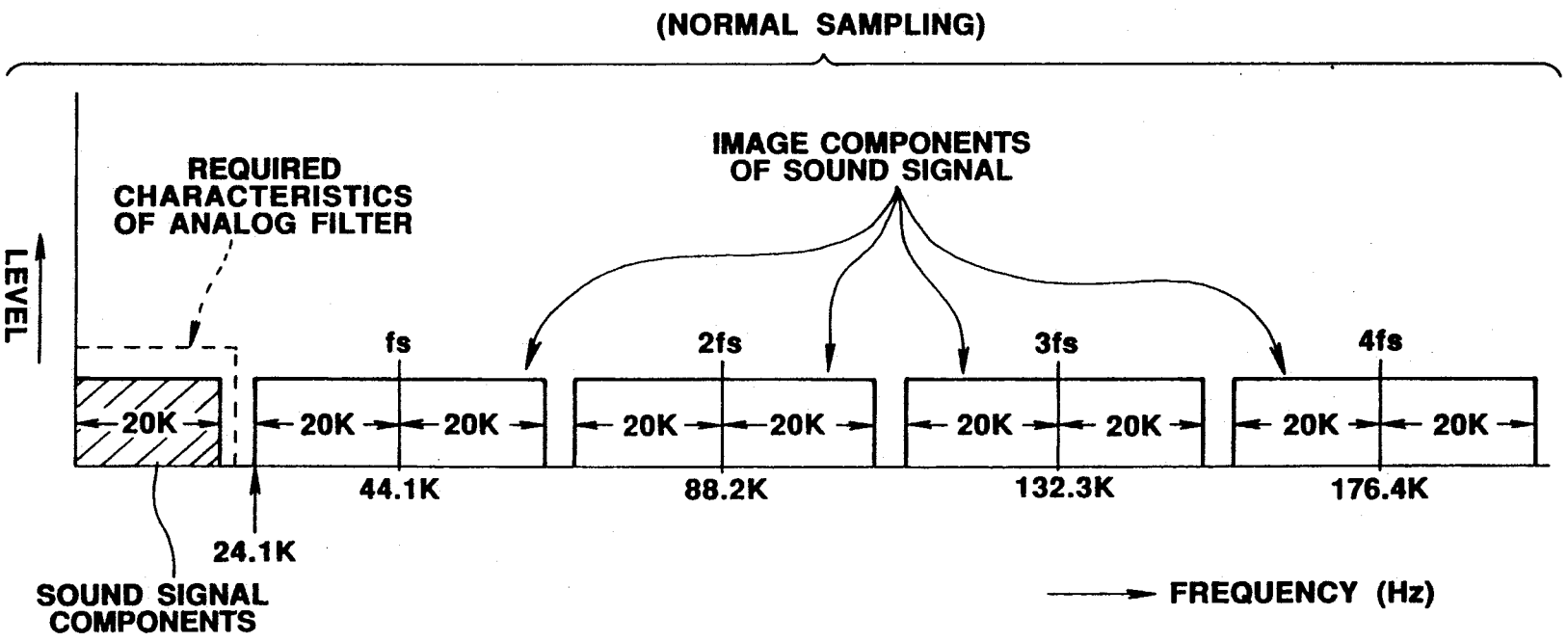
FIG. 17 is a frequency spectrum (No. 1) of a signal output from the D/A convertor.

For example, if a sound signal having a frequency range of 20 KHz is sampled at a sampling frequency fs of 44.1 KHz, sound signal components and their image components appear at fs (=44.1 KHz), 2fs (=88.2 KHz), 3fs (132.3 KHz), 4fs (=176.4 KHz), ... , as shown in FIG. 17, where there is only a frequency discrepancy of 4.1 Khz between the lower limit frequency 24.1 KHz of the image components of the sound signal and the upper limit frequency 20 Khz of the sound signal.

In the demodulation stage, the sound signal is subjected to low-pass filtering process with a cut-off frequency within the narrow frequency range of 4.1 KHz, whereby only sound frequency components less than 20 KHz are allowed to pass through. Image components higher than 20 KHz have to be processed not to be superimposed as reflected noises on the sound frequency components. The above filtering process is re to have a frequency-amplitude characteristic as flat as possible within the frequency range up to 20 KHz, and to have an attenuation rate not less than a target S/N ratio in a cut-off frequency range higher than a frequency of 24.1 KHz. Further, important elements required for the filtering process with respect to tone quality of a sound signal are that a phase characteristic is to be linear, i.e., the process has a flat group-delay characteristic.

To realize the above characteristics using an ordinary analog filter, a filter of a considerably high power is required which strictly meets the above characteristics. Actually, a Chebyshev type active filter of 9th to 13th power is used, but it is hard to realize a flat group-delay characteristic within a given frequency range using this filter.

An over sampling technique serves to solve the above problem. A description of the principle of operation of a fourfold over sampling technique will be given hereafter.

Another sampling operation is effected three times during each original sampling interval, which means that the sampling operation is effected 4 times more frequently, i.e., the number of sampling operations will be 4 times that of the original sampling operations. If the sampling frequency is defined as 4 times the original sampling frequency 44.1 KHz, i.e., 176.4 KHz, the frequency components of the original sound signal sampled by the sampling frequency 4 times the original sampling frequency remain as they are as shown in FIG. 17 and harmonic components higher than 20 KHz are superimposed thereon.

The sound signal sampled by the sampling frequency 4 times the original sampling frequency is subjected to a digital low-pass filtering process with the cut-off frequency 20 KHz, whereby the harmonic components higher than 20 KHz are eliminated.

Figure 18:
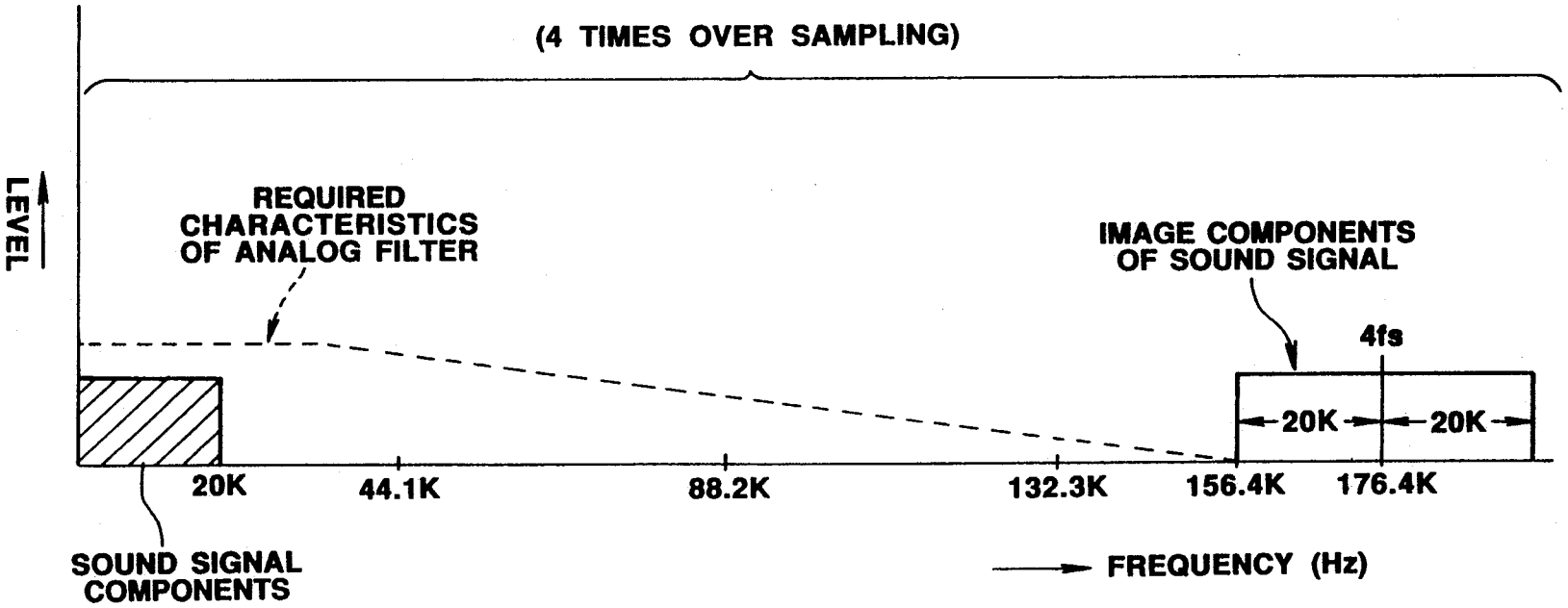
FIG. 18 is a frequency spectrum (No. 2) of a signal output from the D/A convertor.

The sound signal subjected to the above digital filtering process is D/A converted by the over sampling frequency 176.4 KHz. In the frequency spectrum of the D/A converted sound signal, frequency components of the original sound signal appear and image components appear in very frequency ranges within ±20 KHz with the center frequencies 4fs, 8fs, 12fs, ... integer times the over sampling frequency 4fs. As shown in FIG. 18, even the lowest frequency component among the image components is 156.4 KHz and is far remote from the frequencies of the original sound signal.

The D/A converted signal having the above frequency characteristic is put into an analog filter having a dull cut-off characteristic shown by a broken line in FIG. 18, whereby only desired frequency components are obtained as shown in FIG. 18. The analog filter having such a dull cut-off characteristic may be realized by a filter that is of a comparably low power and cheap in price. The filter with a superior group-delay characteristic may be also realized easily.

In the over sampling process, a reproducing system of audio signals which is cheap and of excellent characteristics may be achieved by combination of the digital low-pass filtering process, D/A convertor with a high sampling frequency and a cheap analog filter, rather than by employing an analog filter having a good characteristic.

If possible, the digital signal processing apparatus may directly execute the above digital low-pass filtering process on the sound signal. But if the above process for increasing sampling number and the digital low-pass filtering process are approximately replaced by a linear interpolating process as shown in FIG. 19, the digital signal process may be greatly simplified.

Figure 19:
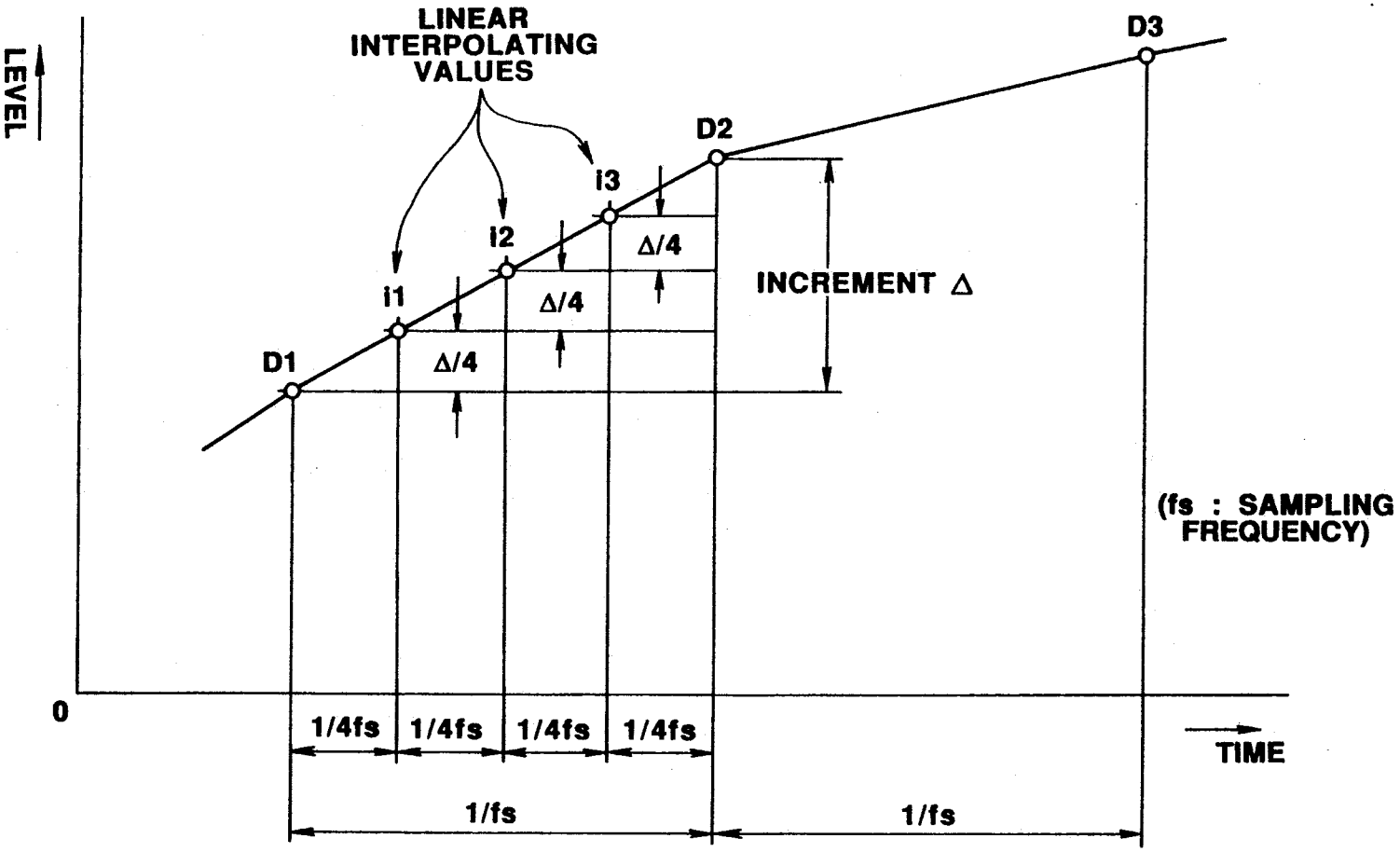
FIG. 19 is a view illustrating a linear interpolation.

In FIG. 19, assuming that the original sample values take D1, D2 and D3 , respectively, and an increment between two adjacent sample values such as D1 and D2 is Δ, one fourth times the increment Δ, one fourth the difference value, i.e., Δ/4 is successively added to the sample value D1 every over sampling period ¼fs, whereby linear interpolated values i1, i2 and i3 are obtained every over sampling timing, respectively.

In the frequency spectrum of a signal sampled with a four fold sampling frequency, high frequency components higher than 20 KHz are almost eliminated similarly to the frequency spectrum of a signal which is subjected to the digital low pass filtering process with the cut-off frequency. In this way, the linear interpolating process will simultaneously obtain effects similar to those which are realized by the above sampling process with a larger sampling number and the digital low pass filtering process.

The processing circuit 105 of FIG. 1 executes the over sampling process through the linear interpolating process, as Will be described in detail.

Principle of Noise Shaping Process

Figure 20:
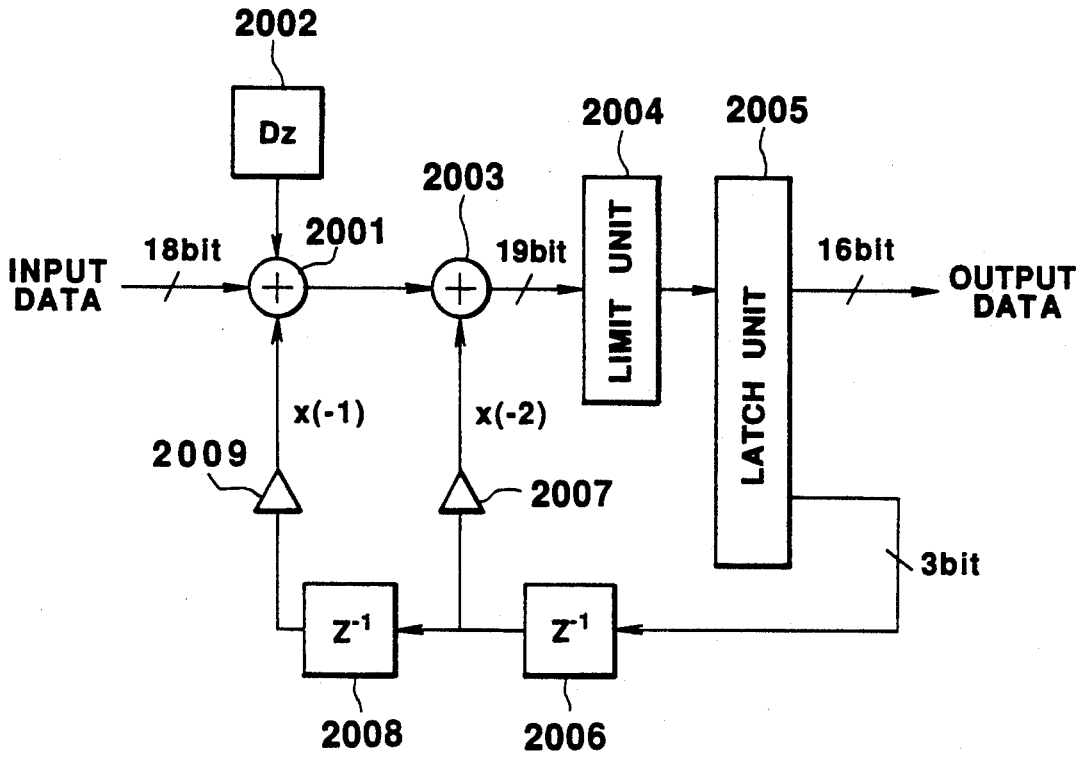
FIG. 20 is a block diagram showing a principle of a noise shaping operation.
Figure 21:
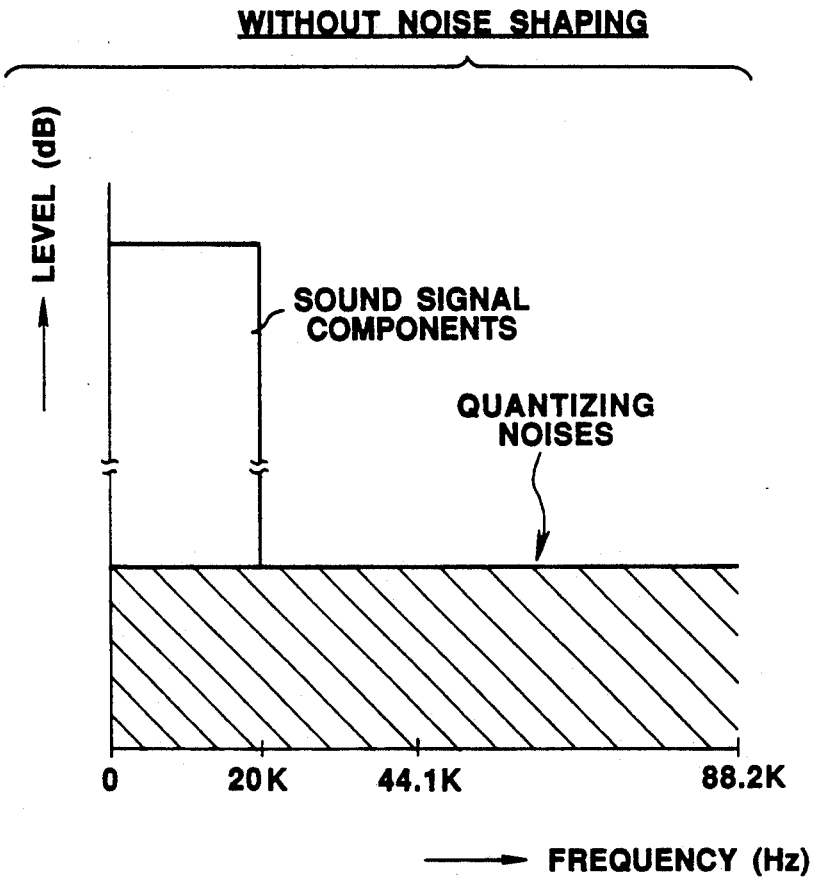
FIG. 21 is a view showing effects (No. 1) of the noise shaping operation.

In the processing circuit 105 of FIG. 1, the noise shaping process shown in a functional block diagram of FIG. 20 is executed in combination with the above over sampling process, whereby quantizing noises are reduced.

In the present embodiment, the musical-tone sample data output from the accumulated wave-height output latch 213 (FIG. 2) of CPU 104 (FIG. 1) has an accuracy of 18 bits, as described above, but a D/A convertor is used whose accuracy is 16 bits. Accordingly, the processing circuit 105 of FIG. 1 quantizes musical-tone sample data of 18 bits from CPU 104 into data of 16 bits to supply the same to the D/A convertor 106.

Low amplitude signal-components of a musical-tone signal, which are expressed by 3 less significant bits, are cut down, causing quantizing noises.

Quantizing noises are equally distributed over the whole frequency range up half the over sampling frequency when the musical-tone signal is not subjected to the noise shaping process, so that quantizing noises are distributed in the frequency range less than a frequency 20 KHz, where sound signal components reside. When a signal involving quantizing noises is D/A converted, the sound signal as well as rasping white noise can be heard.

Figure 22:
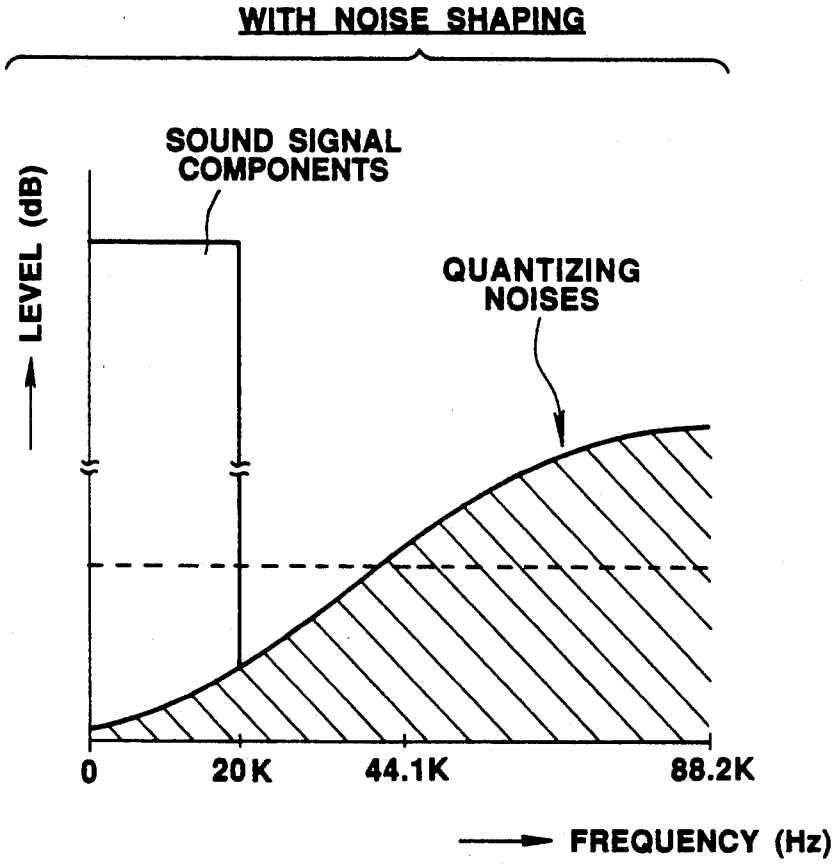
FIG. 22 is a view showing effects (No. 2) of the noise shaping operation.

If it is possible to shift only quantizing noises so as to distribute in the frequency range above the audio frequency range, as shown in FIG. 22, with the whole noise energy kept unchanged, audible noises can be reduced, because the analog filter in the over sampling process depresses signal components higher than a frequency of 20 KHz after the signal is subjected to D/A conversion.

The noise shaping process can be realized by the functional structure of FIG. 20. More specifically, a latch unit 2005 reads out only 16 more significant bits from an input data of 18 bits and outputs the same as an output data of 16 bits. 3 less significant bits to be cut down are input to a kind of a high stressing filter unit consisting of one sample delay units 2006, 2008, multiplying units 2007, 2009 and adder units 2001, 2003, to be fed back to the input data of 18 bits. The frequency characteristic of the quantizing noises which are produced and superimposed on the output data when 3 less significant bits of the input data are cut down will be made as shown in FIG. 22.

The high stressing filter unit performs an arithmetic operation on the input data of 18 bits with an accuracy of 19 bits to increase accuracy of the arithmetic operation. A limit unit 2004 serves to clip the output data of the high stressing filter unit at predetermined upper and lower limits to prevent the output data from overflowing and being reversed in polarity to produce spike noises.

Operation of the dither adding unit (Dz) 2002 will be described later.

The processing circuit 105 of FIG. 1 performs the noise shaping process shown in the functional diagram of FIG. 20 as will be described later in detail.

Principle of Dither Process

In the functional diagram of FIG. 20, the dither adding unit (Dz) 2002 adds very small noises which change in random to the input data of 18 bits through the adder unit 2001. At a stage of quantizing data of 19 bits into data of 16 bits, fine musical-tone signal components involved in the 3 bit data to be cut down are involved in the output data, and these fine musical-tone signal components can be reproduced somewhat audibly.

The processing circuit 105 of FIG. 1 executes the dither process which will be executed by a part of the functional diagram of FIG. 20, as will be described in detail later.

Specific Description of the Processing Circuit

Now, specific structure and operation of the processing circuit 105 will be described which performs the above over sampling process, noise shaping process and dither process.

Whole structure and operation of the processing circuit 105

Figure 23:
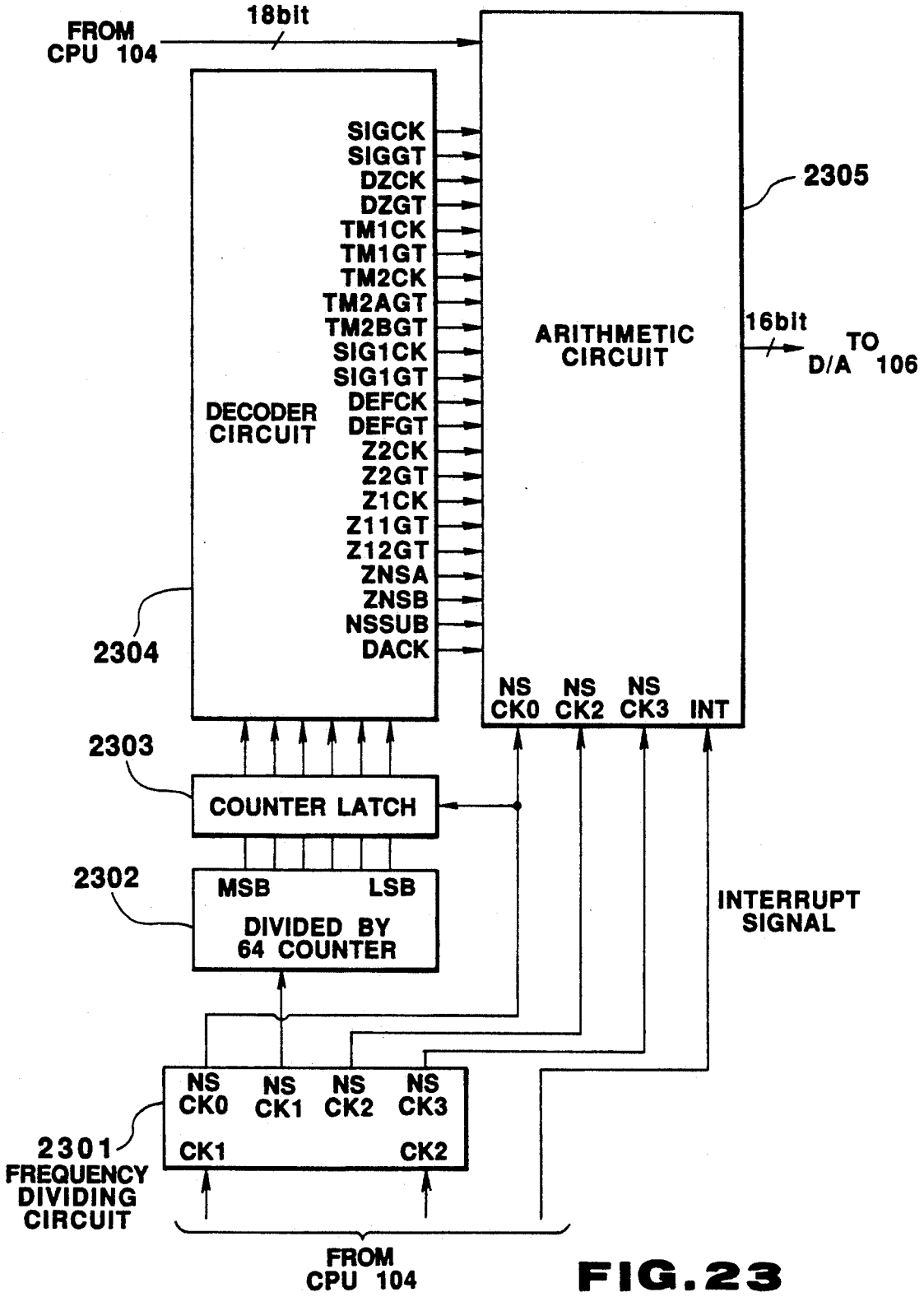
FIG. 23 is a block diagram showing an internal structure of a processing circuit.

FIG. 23 is a block diagram of the processing circuit of FIG. 1.

A frequency dividing circuit 2301 receives master clock signals CK1, CK2 from the clock-signal generating unit 203 of CPU 104 of FIG. 2, and divides both the signals by 16, generating four clock signals, NSCK0, NSCK1, NSCK2, NSCK3, which are of the same frequency but different in phase.

A divided by 64 counter 2302 performs 64 counting operations in accordance with the above clock signal NSCK1. The outputs of the counter 2302 are digital signals. The output signals are latched by a counter latch 2303 in accordance with pulses of the clock signal NSCK0 following the clock signal NSCK1, and further are supplied to a decoder circuit 2304.

As shown in FIG. 23, the decoder circuit 2304 generates various control clock signals in accordance with the output signals of the divided by 64 counter 2302. These control clock signals are used to control the arithmetic circuit 2305.

The arithmetic circuit 2305 is controlled by the clocks signals NSCK0, NSCK2, NSCK3 from the frequency dividing circuit 2301 and the interrupt signal INT from the clock signal generating unit 203 (FIG. 2) of CPU 104 (FIG. 1). The arithmetic circuit 2305 receives musical-tone sample data of 18 bits through the accumulated wave-height output latch 213 (FIG. 2) of CPU 104. The arithmetic circuit 2305 executes the over sampling process, noise shaping process and dither process on the musical-tone sample data, and outputs a resultant musical-tone signal data of 16 bits to D/A convertor 106 (FIG. 1).

Figure 25:
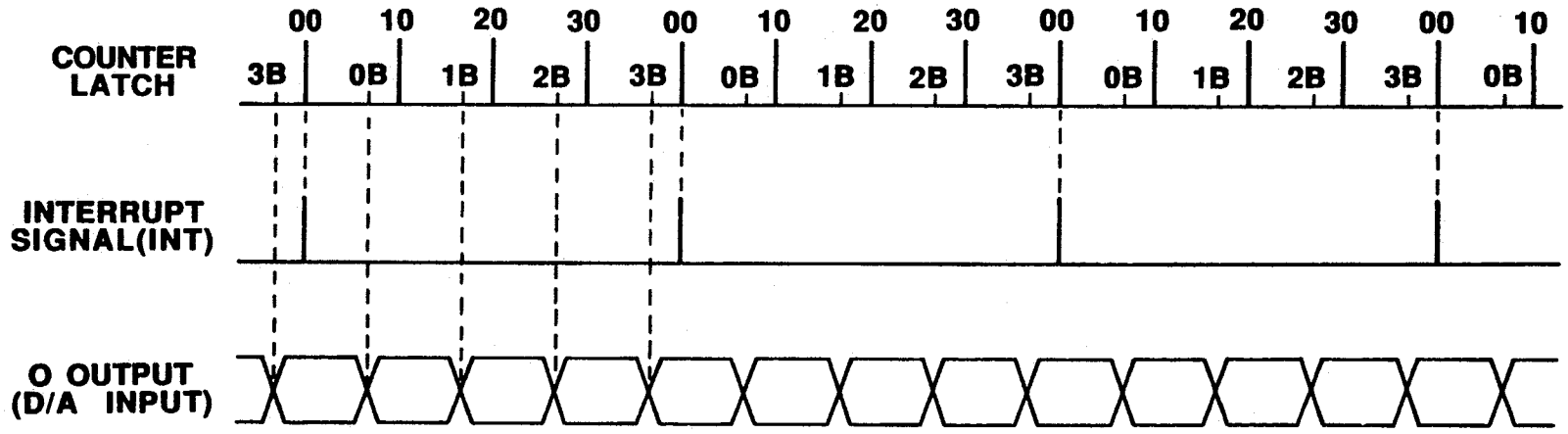
FIG. 25 is a timing chart (No. 2) of clock signals.

As shown in FIG. 25, the clock signal generating unit 203 (FIG. 2) of CPU 104 outputs one pulse of the interrupt signal INT, every time when the divided by 64counter 2302 counts a count value from 00 (H) ("H" represents a hexadecimal numeral) to 3F (H), returning to the count value 00 (H). The period of the interrupt signal INT is equivalent to the sampling cycle of 1/fs.

The divided by 64 counter 2303 counts a count number 16 during respective interrupt periods (i.e., respective sampling periods). As shown in FIG. 25, every time the counter counts OB (H), 1B (H), 2B (H) and 3B (H), an output latch 0 (as will be described later) in the arithmetic circuit 2305 outputs new musical-tone signal data to D/A converter 106 of FIG. 1. The output period of the musical-tone signal data will be 1/fs, which is equivalent to the four hold over sampling period.

As described above, the over sampling process will be effected with the sampling frequency 4 times the original sampling frequency, but in the present embodiment, the arithmetic circuit 2305 executes the over sampling process for linear-interpolating between the adjacent sample values with three interpolating values based on a difference value therebetween as described in FIG. 19.

More specifically, every time the divided by 64 counter 2301 counts 16-counts, the arithmetic circuit 2305 calculates one interpolating value and outputs it as a musical-tone signal to D/A convertor 106. Further, every time the divided by 64 counter 2302 counts 64-counts and returns to 0-count, the accumulated wave-height output latch 213 (FIG. 2) of CPU 104 (FIG. 1) inputs a new sample value to the arithmetic circuit 2305. The arithmetic circuit 2305 further executes the linear interpolating process based on the new sample value.

The above noise shaping process and the dither process are executed every time the arithmetic circuit 2305 calculates an interpolating value.

Structure of Arithmetic Circuit

Description of a specific structure and operation of the arithmetic circuit 2305 will be given.

Figure 26:
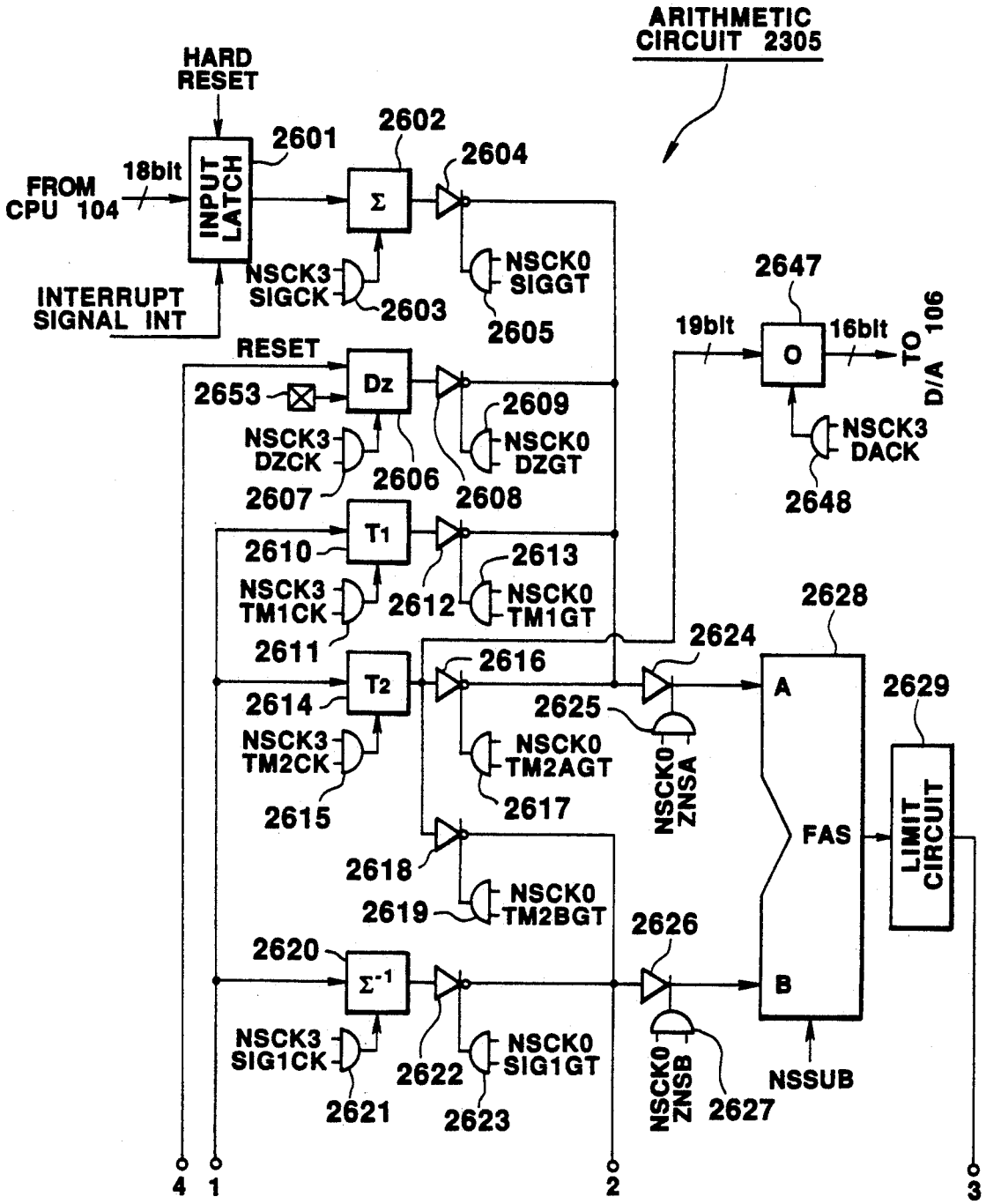
FIG. 26 is a block diagram (No. 1) showing an internal structure of an arithmetic circuit.
Figure 27:
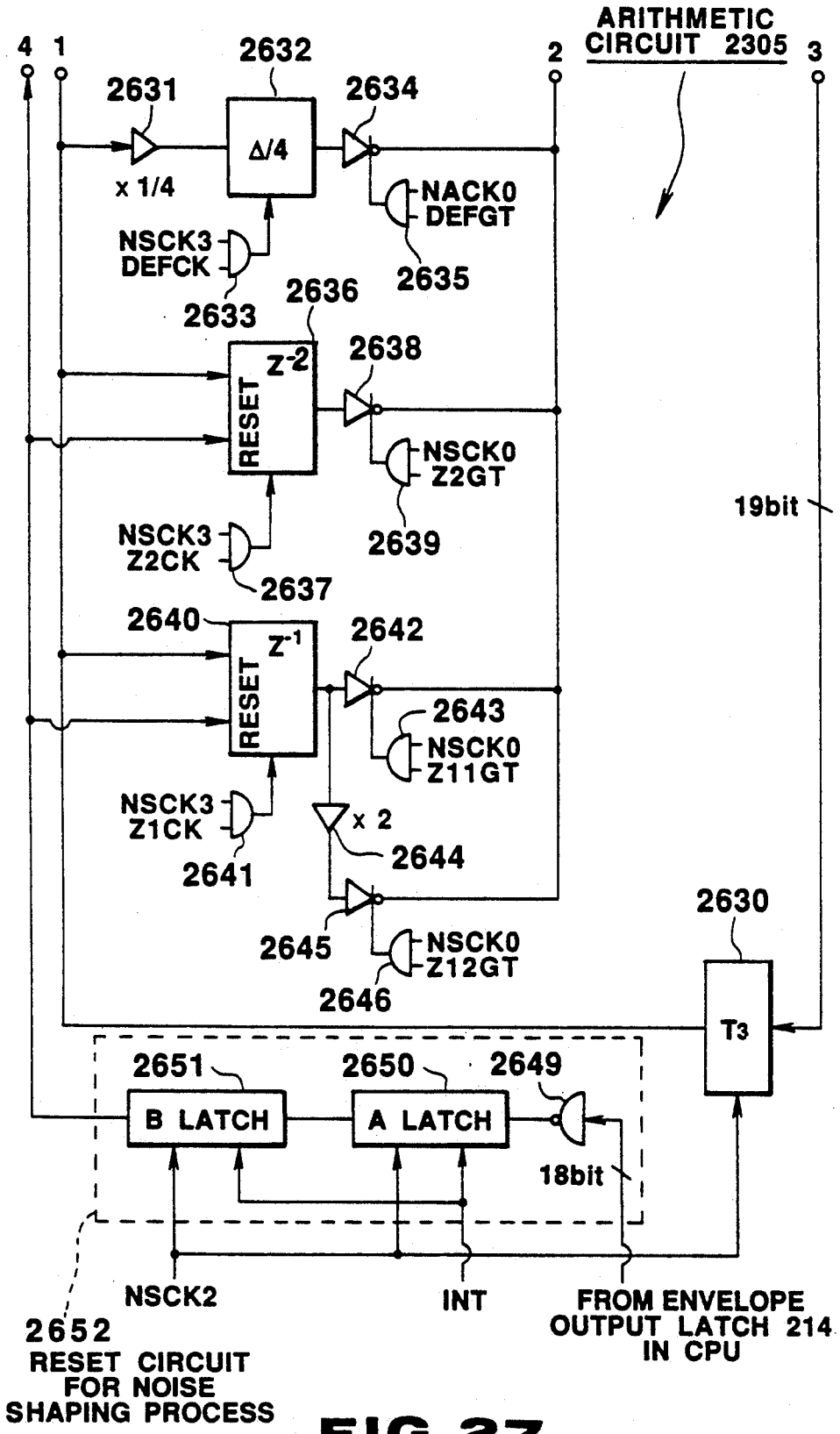
FIG. 27 is a block diagram (No. 2) showing an internal structure of an arithmetic circuit.

FIGS. 26 and 27 are circuit diagrams of the arithmetic circuit (FIG. 23) in the processing circuit 105 (FIG. 1).

The input latch 2601 latches musical-tone sample data of 18 bits output from the accumulated wave-height output latch 213 in CPU 104. The input latch 2601 has an important function that makes CPU 104 and the processing circuit 105 operate in synchronism with each other.

Figure 28:
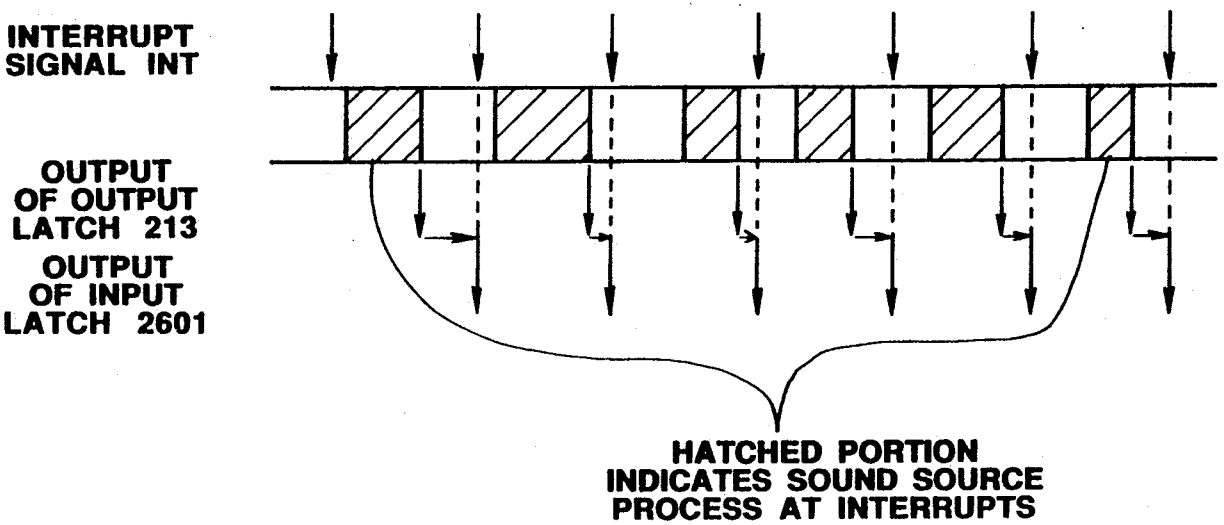
FIG. 28 is a view illustrating a synchronized operation of the CPU and the processing circuit.

Since the time which CPU 104 having the structure shown in FIG. 2 takes to execute the sound-source process varies depending on conditions under which software (for example, a program run in accordance with the flow charts of FIGS. 12 to 15) for the sound-source process runs, timings are not constant as shown in FIG. 28 when musical-tone sample data are latched in the accumulated wave-height output latch 213 (FIG. 2) after completion of the sound-source process. Therefore, if the output of the accumulated wave-height output latch 213 is directly supplied to the following processing circuit 105, CPU 104 and the processing circuit 105 do not operate in synchronism with each other.

To overcome the above problem, in the present embodiment, the output of the accumulated wave-height output latch 213 is input to the input latch 2601 (FIG. 26), while musical-tone sample data is also latched in the input latch 2601 in accordance with the interrupt signal INT that has intervals equivalent to those of the sampling clock generated by the clock signal generating unit 203 of FIG. 2. As a result, the musical-tone sample data output from CPU 104 are input to the processing circuit 105 at constant intervals in synchronism with the interrupt signal INT, as shown in FIG. 28.

As described above, CPU 104 and the processing circuit 105 are allowed to operate in synchronism with each other.

Hereinafter, operation operated by the input latch 2601 of FIG. 26 when the power is turned on will be described.

When the electronic musical instrument having the structure shown in FIG. 1 is turned on, the operation analyzing unit 207 (FIG. 2) of CPU 104 starts executing a program in accordance with the main flow chart of FIG. 3. At step S301 of FIG. 3, the initializing process is effected when the power is turned on. In a software process, contents of RAM (FIG. 2) and the accumulated wave-height output latch 213 are initialized.

A predetermined time is needed before the program according to the main flow chart of FIG. 3 is executed after the power is turned on. Hence, a little time is required before the software initializing process is effected.

Meanwhile, since the processing circuit 105 which is provided outside CPU 104 starts operation independently of CPU 104 the moment the power is turned on, data latched in the input latch 2601 is not secured during a little time before the contents of the accumulated wave-height output latch 213 are reset.

As a result, there is a possibility that contents of the input latch 2601 are processed by the processing circuit 105 and further transferred to D/A convertor 106 (FIG. 1), being output as noise.

In the present embodiment, to prevent generation of noise, the input latch 2601 (FIG. 26) in the processing circuit 105 is compulsorily reset by means of hardware the moment the power is turned on.

Structure of Arithmetic Circuit—General Operation

Processes will be described with reference to FIG. 29 which are performed at timings designated by the counter latch 2303 of FIG. 23 and the arithmetic circuit 2305 having the structure shown in FIGS. 26 and 27.

In FIG. 29, contents of transfer between latches and contents of arithmetic operations, to be performed in respective processes are represented in a "Function" column. "Functions" correspond to contents to be performed in respective processes, respectively, and further correspond to process numbers indicated in "Process Column".

In "Counter Latch" column of FIG. 29 are indicated values of the counter latch 2303 (FIG. 23), which designate timings when respective processes are performed. The decoder circuit 2304 (FIG. 23) generates control clock signals based on the values of the counter latch 2303.

Figure 24:
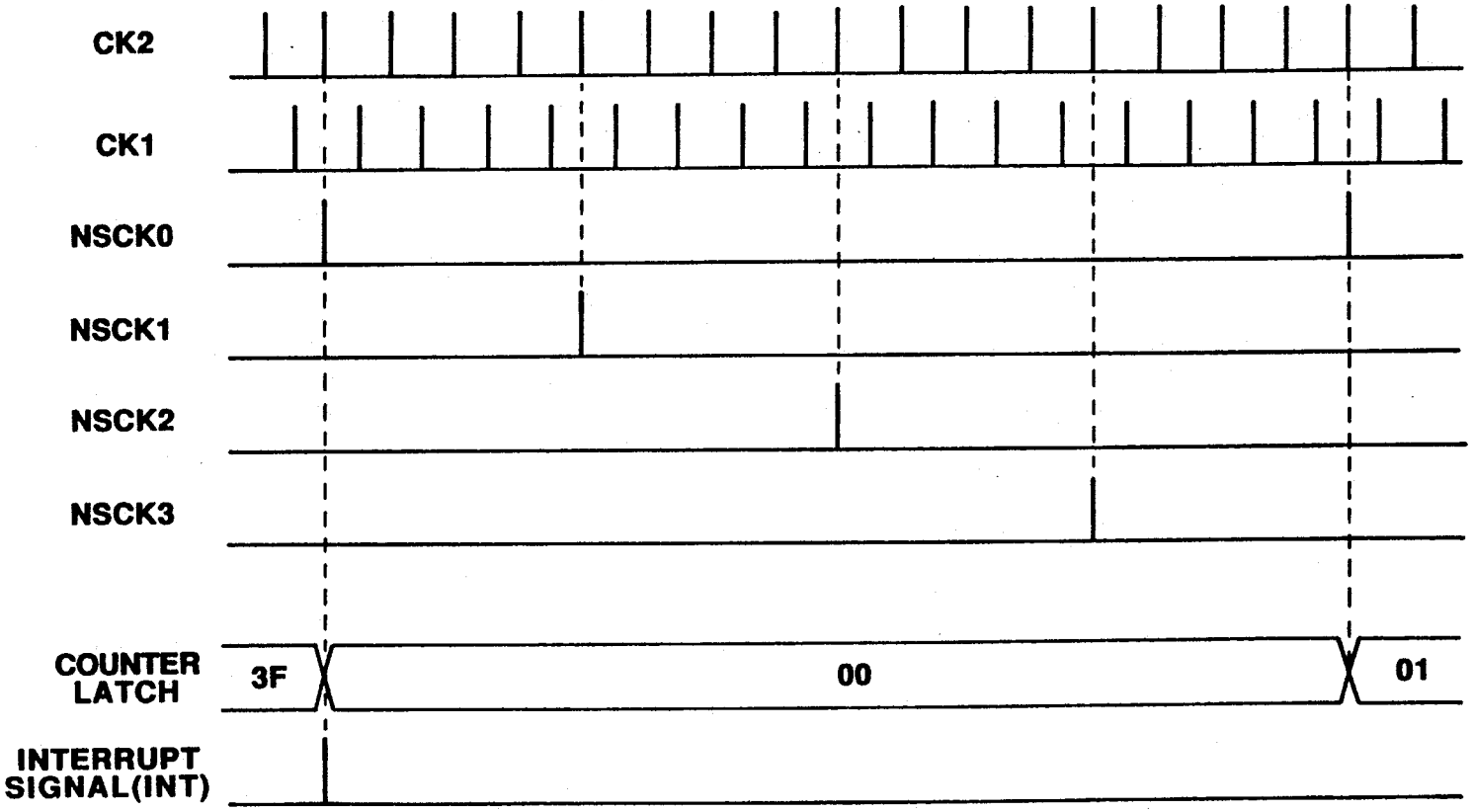
FIG. 24 is a timing chart (No. 1) of clock signals.

Corresponding to respective functions, all outputs of the respective latch circuits (for example, T1 latch circuit 2610) are led to pass through an input terminal A or B (hereafter, referred to as FAS-A or FAS-B) of an adder/subtractor (FAS) 2628. For that purpose, output gates of the respective latches (for example, an output gate 2612 of the T1 latch circuit 2610) must be made open and at the same time one of the input gates 2624, 2626 or both the input gates must be made open in accordance with the content of the "function" of FIG. 29. The output gates of the respective latches (for example, the output gate 2612 of the T1 latch circuit 2610) is made open at a timing of the clock signal NSCK0 (see FIG. 24), when the control clock signal output from the decoder circuit 2304 (FIG. 23) is at a high level, because AND gate (for example, 2613) controlling the output gate is ON. The control clock signal is shown in FIG. 29 as "FAS-A input gate clock" or "FAS-B input gate clock".

The input gates 2624, 2626 to the adder/subtractor FAS 2628 are open when control clock signals output from the decoder 2304 (FIG. 23) are at a low level "0" and AND gate 2625 or 2627 is OFF. The input gates 2624, 2626 to the adder/subtractor FAS 2628 are closed when control clock signals output from the decoder 2304 (FIG. 23) are at a high level "1" and AND gate 2625 or 2627 is ON. The control clock signals for controlling the input gates 2624 and 2626 are shown as "ZNSA" and "ZNSB" in FIG. 29.

The adder/subtractor FAS 2628 performs either addition or subtraction depending on whether the control clock signal is at a high level or at a low level. The control clock signal is shown as "NSSUB (SUBTRACTION)" in FIG. 29.

The result of the arithmetic operation of FAS 2628 is fed back to the respective latch circuits (for example, T1 latch circuit) of FIGS. 26 and 27 through a limit circuit 2629 and T3 latch circuit 2630. In this state, AND gate (for example, 2633) for controlling input of a relevant latch becomes ON at the timing (see FIG. 24) of the clock signal NSCK3 when the control clock signal output from the decoder circuit 2304 (FIG. 23) is at a high level. The control clock signal is shown as "latch clock" in FIG. 29.

The limit circuit 2629 has the same function as the limit unit 2004, and serves to clip the output of FAS 2628, if necessary, to prevent the output of FAS 2628 from over flowing, i.e., exceeding 19 bits.

Structure of Arithmetic Circuit—Processes 1–6

Specific operation of the arithmetic circuit 2305 having the structure shown in FIGS. 26, 27 will be described with reference to FIG. 29.

Figure 30:
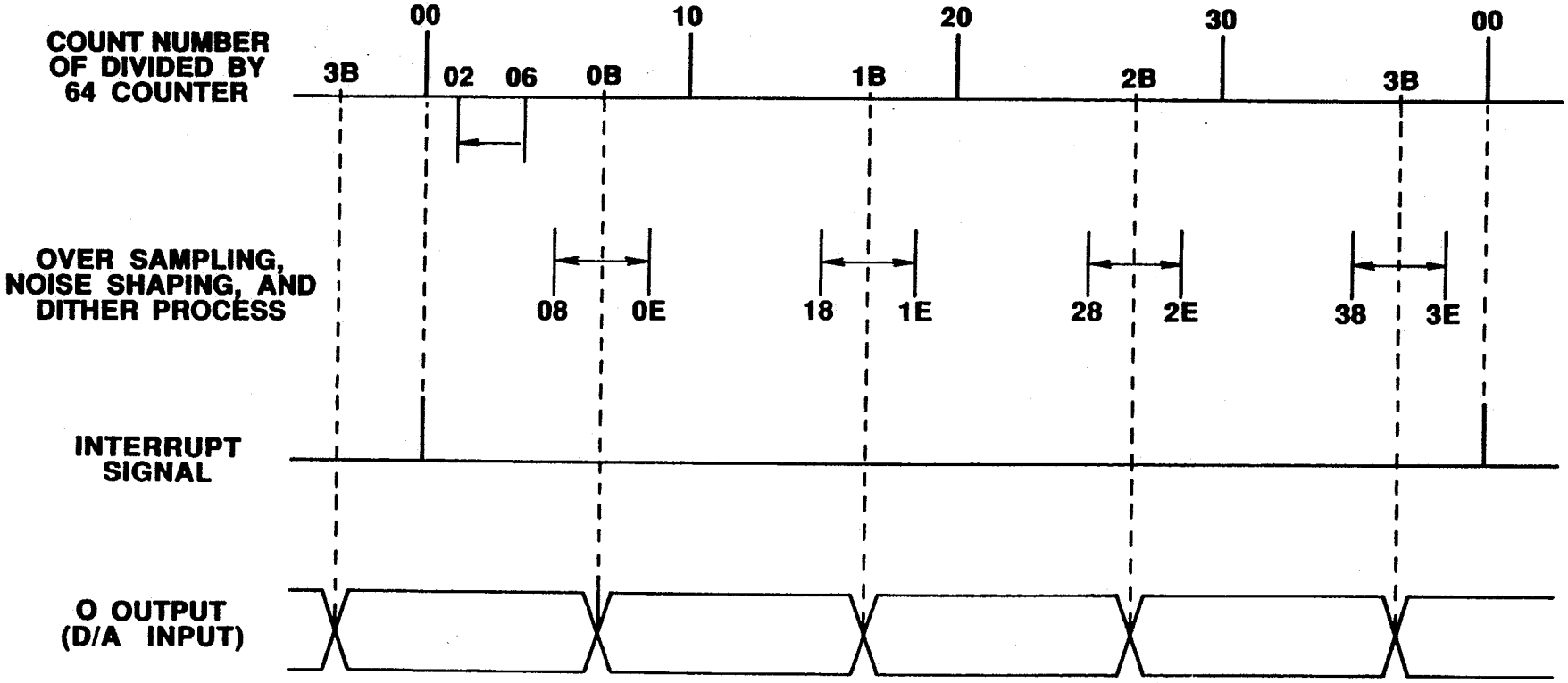
FIG. 30 is a timing chart of processes executed by the arithmetic circuit.

The divided by 64 counter 2302 of FIG. 23 repeats counting operation 00 (H) to 3F (H) every period of the interrupt signal INT sent from CPU 104, as shown in FIG. 30, but no process is performed at the count numbers 00 (H) and 01 (H). At the count numbers 02 (H) to 06 (H) are executed preparation processes for the over sampling process, noise shaping process and dither process.

The preparation processes are shown as process 1 to process 6 in FIG. 29.

Musical-tone sample data of 18 bits from CPU 104 are transferred in the arithmetic circuit 2305 of FIGS. 26, 27 from the input latch 2601 through Σ latch 2602, $\Sigma^{-1}$ latch 2620, to T1 latch 2610 and T2 latch 2614. The function of the input latch 2601 has been described. Σ latch 2602 and $\Sigma^{-1}$ latch 2620 hold the current musical-tone sample data and musical-tone sample data of the last sampling timing (interrupt timing), transferred from the input latch 2601 to calculate a difference value for the linear interpolation. T1 latch 2610 holds an interpolating value in the linear interpolating process or in the over sampling process. T2 latch 2614 holds data in the noise shaping process and the dither process.

Structure of Arithmetic Circuit—Process 1

At the timing when the counter latch 2303 (FIG. 23) indicates a count value 02 (H), the musical-tone sample data of the last sampling timing (interrupt timing) is transferred from Σ latch 2602 to $\Sigma^{-1}$ latch 2620 (Process 1 of FIG. 29), that is the output of Σ latch 2602 is input to $\Sigma^{-1}$ latch 2620 through the output gate 2604, FAS 2628, the limit circuit 2629 and T3 latch 2630.

Description of the more specific operation will be given below. The timing chart of FIG. 24 and the table (counter latch 02 (H)) of FIG. 29 shall be referred to from time to time.

A signal SIGGT is input as FAS-A input-gate clock signal to the arithmetic circuit 2305 from the decoder 2304, causing the output gate 2604 of Σ latch 2602 to open at an input timing of a clock signal NSCK0.

Receiving "0" as the control clock signal ZNSA from the decoder 2304, AND gate 2625 outputs a low level signal, making ON the input gate 2624 of FAS 2628. Meanwhile, receiving "1" as the control clock signal ZNSB from the decoder 2304, AND gate 2627 outputs a high level signal at an input timing of the clock signal NSCKO, making OFF the input gate 2626 of FAS 2628. Since the control clock signal NSSUB supplied from the decoder 2304 to FAS 2628 is "0", FAS 2628 executes an adding operation.

FAS 2628 adds a value "0" input to FAS-B to a value input to FAS-A, outputting at the output terminal an output of Σ latch 2602 which is input through FAS-A.

The output of the FAS 2628 passes through the limit circuit 2629 and T3 latch 2630 at an input timing of the clock signal NSCK2. Having received SIGICK as a latch clock signal from the decoder 2304, AND gate 2621 is made ON at an input timing of the clock signal NSCK3, whereby the output of the T3 latch 2630 is latched in $\Sigma^{-1}$ latch 2620.

In the above process, the contents of Σ latch 2602 are transferred to $\Sigma^{-1}$ latch 2620.

Arithmetic Circuit—Process 2

Musical-tone sample data latched in the input latch 2601 is transferred to E latch 2602 at a timing when the counter latch 2303 indicates a count number 03 (H) (Process 2 of FIG. 29). Musical-tone sample data has been latched in the input latch 2601 from the accumulated wave-height output latch 213 (FIG. 2) of CPU 104 (FIG. 1) at an input timing of the interrupt signal INT (see FIG. 24).

As will be understood from the column of the counter latch of 03 (H) shown in FIG. 29, AND gate 2603 receives a signal SIGCK as a latch clock signal from the decoder 2304 and is made ON, whereby the above process is performed.

Structure of Arithmetic Circuit—Process 3

A dither value held in Dz latch 2606 is added to musical-tone sample data of the last sampling timing (interrupt timing) latched in $\Sigma^{-1}$ latch 2620 at a timing when the counter latch 2303 (FIG. 23) indicates a count number 04 (H), and the resultant sum is transferred to T2 latch 2614 (Process 3 of FIG. 29). The process 3 corresponds to the functions of the dither adding unit (Dz) 2002 and the adder unit 2001. In the process 3, the noise shaping process is effected on contents of T2 latch 2614, as will be described later.

Description of the more specific operation will be given below. The timing chart of FIG. 24 and the table (counter latch 04 (H)) of FIG. 29 shall be referred to from time to time.

A signal SIGIGT is input as FAS-B input-gate clock signal to the arithmetic circuit 2305 from the decoder 2304, causing the output gate 2622 of $\Sigma^{-1}$ latch2620 to open at an input timing of a clock signal NSCKO. Receiving "0" as the control clock signal ZNSB from the decoder 2304, AND gate 2627 outputs a low level signal, making ON the input gate 2626 of FAS 2628. As a result, musical-tone sample data of the last sampling timing which is held in $\Sigma^{-1}$ latch 2620 in the process 1 is input to FAS 2628 through FAS-B.

Meanwhile, a signal DZGT is input as FAS-A input-gate clock signal from the decoder 2304, causing the output gate 2608 of Dz latch 2606 to open at an input timing of a clock signal NSCKO. Receiving "0" as the control clock signal ZNSA from the decoder 2304, AND gate 2625 outputs a low level signal, making ON the input gate 2624 of FAS 2628. As a result, a dither value which is generated by a random number generating circuit 2653 and is held in Dz latch 2606 in the process 10 of FIG. 29 as will be described later is input to FAS 2628 through FAS-A.

Since a control clock signal NSSUB of "0" is input from the decoder 2304 to FAS 2628, FAS 2628 adds together the dither value of Dz latch 2606 which is input through FAS-A and the output of $\Sigma^{-1}$ latch 2620 which is input through FAS-B.

The resultant sum passes through the limit circuit 2629 and T3 latch 2630 at an input timing of the clock signal NSCK2. Since a signal TM2CK is input as a latch clock signal from the decoder 2304 to the arithmetic circuit 2305, AND gate 2615 is made ON at an input timing of the clock signal NSCK3 and the output of T3 latch 2630 is latched in T2 latch 2614.

Through the above process, a dither value is added to musical-tone sample data of the last sampling timing (interrupt timing) latched in $\Sigma^{-1}$ latch 2620, and the sum is transferred to T2 latch 2614.

Structure of Arithmetic Circuit—Process 4

Process for calculating a step value $\Delta/4$ used in the linear interpolation process or the over sampling process is performed at a timing when the counter latch 2303 (FIG. 23) indicates a count number 05 (H) (Process 4 of FIG. 29). The step value $\Delta/4$ is obtained by dividing the current increment $\Delta$ between a current sample value and the last sample value by 4, as shown in FIG. 19. At this timing, musical-tone sample data of the last sampling timing which is held in $\Sigma^{-1}$ latch 2620 in the process 1 is subtracted from musical-tone sample data of the current sampling timing (interrupt timing) which is held in $\Sigma$ latch 2602 in the process 2. The difference is divided by 4 and then the step value $\Delta/4$ is obtained. The step value $\Delta/4$ is latched in $\Delta/$ latch 2632.

Description of the more specific operation will be given below. The timing chart of FIG. 24 and the table (counter latch 05 (H)) of FIG. 29 shall be referred to from time to time.

A signal SIGGT is input as FAS-B input-gate clock signal to the arithmetic circuit 2305 from the decoder 2304, causing the output gate 2604 of $\Sigma$ latch 2602 to open at an input timing of a clock signal NSCKO. Receiving "0" as the control clock signal ZNSA from the decoder 2304, AND gate 2625 outputs a low level signal, making ON the input gate 2624 of FAS 2628. As a result, musical-tone sample data of the current sampling timing which is held in $\Sigma$ latch 2620 is input to FAS 2628 through FAS-A.

Meanwhile, a signal SIGlGT is input as FAS-B input-gate clock signal to the arithmetic circuit 2305 from the decoder 2304, causing the output gate 2622 of $\Sigma^{-1}$ latch 2620 to open at an input timing of a clock signal NSCKO. Receiving "0" as the control clock signal ZNSB from the decoder 2304, AND gate 2627 outputs a low level signal, making ON the input gate 2626 of FAS 2628. As a result, musical-tone sample data of the last sampling timing held in $\Sigma^{-1}$ latch 2620 is input to FAS 2628 through FAS-B.

Since a control clock signal NSSUB of "1" is input from the decoder 2304 to FAS 2628, FAS 2628 subtracts the output of $\Sigma^{-1}$ latch 2620 which is input through FAS-B from the output of $\Sigma$ latch 2602 which is input through FAS-A.

The resultant difference passes through the limit circuit 2629 and T3 latch 2630 at an input timing of the clock signal NSCK2. Since a signal DEFCK is input as a latch clock signal from the decoder 2304 to the arithmetic circuit 2305, AND gate 2633 is made ON at an input timing of the clock signal NSCK3 and the output of T3 latch 2630 is divided by 4 in a divider 2631. The resultant step value $\Delta/4$ is latched in $\Delta/4$ latch 2614. The divider 2623 is a circuit which performs 2-bit right shift operation on parallel data of 19 bits that is input from FAS 2628 through the limit circuit 2629 and T3 latch 2630.

As described above, the step value $\Delta/4$ for linear interpolation is latched in $\Delta/4$ latch 2614.

Structure of Arithmetic Circuit—Process 5

At the timing when the counter latch 2303 (FIG. 23) indicates a count value 06 (H), the musical-tone sample data of the last sampling timing (interrupt timing) which is latched in $\Sigma^{-1}$ latch 2620 in the process 1 is transferred from to T1 latch 2610 (Process 5 of FIG. 29). The linear interpolating process, that is, the over sampling process is performed on contents of T1 latch 2610.

Description of the more specific operation will be given below. The timing chart of FIG. 24 and the table (counter latch 06 (H)) of FIG. 29 shall be referred to from time to time.

A signal SIGlGT is input as FAS-B input-gate clock signal to the arithmetic circuit 2305 from the decoder 2304, causing the output gate 2622 of $\Sigma^{-1}$ latch 2620 to open at an input timing of a clock signal NSCKO.

Receiving "0" as the control clock signal ZNSB from the decoder 2304, AND gate 2627 outputs a low level signal, making ON the input gate 2626 of FAS 2628. Meanwhile, receiving "1" as the control clock signal ZNSA from the decoder 2304, AND gate 2625 outputs a high level signal at an input timing of the clock signal NSCK0, making OFF the input gate 2624 of FAS 2628. Since the control clock signal NSSUB supplied from the decoder 2304 to FAS 2628 is "0", FAS 2628 executes adding operation.

FAS 2628 adds a value "0" input to FAS-B to a value input to FAS-A, outputting at the output terminal an output of $\Sigma^{-1}$ latch 2620 which is input through FAS-B.

Then, the output of the FAS 2628 passes through the limit circuit 2629 and T3 latch 2630 at an input timing of the clock signal NSCK2. Having received TMlCK as a latch clock signal from the decoder 2304, AND gate 2611 is made ON at an input timing of the clock signal NSCK3, whereby the output of the T3 latch 2630 is latched in T1 latch 2610.

In the above process, the contents of $\Sigma^{-1}$ latch 2620 are transferred to T1 latch 2610.

Through the process 1 to process 5 of FIG. 29, the preparation process for the over sampling process, noise shaping process and dither process has been finished.

Structure of Arithmetic Circuit—Processes 6–12

Following the above processes, the linear interpolating process, i.e., the noise shaping process and over sampling process, and the dither process are executed.

As shown in FIG. 30, the noise shaping process, over sampling process and dither process are each performed once in respective periods in which the counter latch 2303 counts count numbers from 08 (H) to 0E (H), 18 (H) to 1E (H), 28(H) to 2E (H) and 38 (H) to 3E (H) during a period of the interrupt signal INT. In other words, the above processes are each performed once in a period of one fourth times a period of the interrupt signal INT, and the former period will correspond to a 4 times over sampling period.

The above processes are indicated in FIG. 29 as processes 6 to 12 represented by count numbers of the counter latch 2303 "—8" to "—E", respectively, where "—" stands for any 0, 1, 2 and 3.

Structure of Arithmetic Circuit—Process 6

The noise shaping process is performed through processes 6 to 9 of FIG. 29, which corresponds to the functional structure of FIG. 20.

In the process 6 which will be executed at a timing when the counter latch 2303 (FIG. 23) indicates count numbers "−8" (H) the contents of $Z^{-2}$ latch 2636 are subtracted from contents of T2 latch 2614, and the difference is latched in latch 2614.

Over sampling data subjected to the dither process through the above process 2 of FIG. 29 or processes 10 to 12 of FIG. 29 to be described later has been latched in T2 latch 2614. Further, signal components of 3 less significant bits are cut down from musical-tone sample data of 19 bits subjected to the noise shaping process through processes 8 and 9 of FIG. 29 as will be described later, and are delayed by $Z^{-1}$ latch 2640 by 2 over sampling timings. A signal comprising the signal components has been latched in $Z^{-2}$ latch 2636.

T2 latch 2614 corresponds to a latch unit 2005 of FIG. 20, and the process 6 of FIG. 29 corresponds to processes of the delay units 2006 and 2008, the multiplying unit 2009 and the adder unit 2001.

Description of the more specific operation will be given below. The timing chart of FIG. 24 and the table (counter latch "−8" (H)) of FIG. 29 shall be referred to from time to time.

A signal TM2AGT is input as an FAS-A input-gate clock signal to the arithmetic circuit 2305 from the decoder 2304, causing the output gate 2616 of T2 latch 2614 to open at an input timing of a clock signal NSCKO. Receiving "0" as the control clock signal ZNSA from the decoder 2304, AND gate 2625 outputs a low level signal, making ON the input gate 2624 of FAS 2628. As a result, over sampling data which is subjected to the dither process and is held in T2 latch 2614 is input to FAS 2628 through FAS-A.

Meanwhile, a signal Z2GT is input as an FAS-B input-gate clock signal to the arithmetic circuit 2305 from the decoder 2304, causing the output gate 2638 of $Z^{-2}$ latch 2636 to open at an input timing of the clock signal NSCKO. Receiving "0" as the control clock signal ZNSB from the decoder 2304, AND gate 2627 outputs a low level signal, making ON the input gate 2626 of FAS 2628. As a result, delayed sample data held in $Z^{-2}$ latch 2636 is input to FAS 2628 through FAS-B.

Since a control clock signal NSSUB of "1" is input from the decoder 2304 to FAS 2628, FAS 2628 subtracts the output of $Z^{-2}$ latch 2636 which is input through FAS-B from the output of T2 latch 2614 which is input through FAS-A.

The resultant difference passes through the limit circuit 2629 and T3 latch 2630 at an input timing of the clock signal NSCK2. Since a signal TM2CK has been input as a latch clock signal from the decoder 2304 to the arithmetic circuit 2305, AND gate 2633 is made ON at an input timing of the clock signal NSCK3 and the output of T3 latch 2630 is newly latched in T2 latch 2614.

Structure of Arithmetic Circuit—Process 7

In a process 7 of FIG. 29 which is performed at a timing when the counter latch 2303 (FIG. 23) indicates a count number "−9" (H), 2 times the contents of $Z^{-1}$ latch 2640 are added to the contents of T2 latch 2614, and the resultant sum is newly latched in T2 latch 2614.

Similarly in the process 9 of FIG. 29, over sampling data subjected to the dither process through the above process 3 of FIG. 29 or processes 10 to 12 of FIG. 29 to be described later has been latched in T2 latch 2614. A signal comprising signal components of 3 less significant components has been latched in $Z^{-1}$ latch 2640, the signal components of 3 less significant bits which are cut down from musical-tone sample data of 19 bits subjected to the noise shaping process, and are delayed by $Z^{-1}$ latch 2640 by one over sampling timing, through process 9 of FIG. 29 as will be described later.

The process 7 of FIG. 29 corresponds to processes of the delay unit 2006, the multiplying unit 2007 and the adder unit 2003.

Description of the more specific operation will be given below. The timing chart of FIG. 24 and the table (counter latch "−9" (H)) of FIG. 29 shall be referred to from time to time.

A signal TM2AGT is input as an FAS-A input-gate clock signal to the arithmetic circuit 2305 from the decoder 2304, causing the output gate 2616 of T2 latch 2614 to open at an input timing of a clock signal NSCKO. Receiving "0" as the control clock signal ZNSA from the decoder 2304, AND gate 2625 outputs a low level signal, making ON the input gate 2624 of FAS 2628. As a result, over sampling data which is subjected to the dither process and is held in T2 latch 2614 is input to FAS 2628 through FAS-A.

Meanwhile, a signal Z12GT is input as an FAS-B input-gate clock signal to the arithmetic circuit 2305 from the decoder 2304, causing the output gate 2645 of $Z^{-1}$ latch 2640 to open at an input timing of the clock signal NSCKO. Receiving "0" as the control clock signal ZNSB from the decoder 2304, AND gate 2627 outputs a low level signal, making ON the input gate 2626 of FAS 2628. As a result, delayed sample data held in $Z^{-1}$ latch 2640 is multiplied by 2 in a multiplying unit 2644 and input to FAS 2628 through FAS-B. The multiplying unit 2644 is a circuit which executes a one-bit left shift operation.

Since a control clock signal NSSUB of "0" is input from the decoder 2304 to FAS 2628, FAS 2628 adds 2 times the output of $Z^{-1}$ latch 2640 which is input through FAS-B to output of T2 latch 2614 which is input through FAS-A.

The resultant sum passes through the limit circuit 2629 and T3 latch 2630 at an input timing of the clock signal NSCK2. Since a signal TM2CK has been input as a latch clock signal from the decoder 2304 to FAS 2628, AND gate 2633 is made ON at an input timing of the clock signal NSCK3 and the output of T3 latch 2630 is newly latched in T2 latch 2614.

Structure of Arithmetic Circuit—Process 8

In a process 8 of FIG. 29 which is performed at a timing when the counter latch 2303 (FIG. 23) indicates a count number "−A" (H), contents of $Z^{-1}$ latch 2640 are transferred to $Z^{-2}$ latch 2636. A signal comprising signal components of 3 less significant bits has been latched in $Z^{-1}$ latch 2640, the signal components which are cut down from musical-tone sample data of 19 bits subjected to the noise shaping process, and are delayed by one sampling timing, through process 9 of FIG. 29 as will be described later.

The process 8 of FIG. 29 corresponds to a process for delaying contents of the delay unit 2008 of FIG. 20 by one over sampling timing through the delay unit 2008.

Description of the more specific operation will be given below. The timing chart of FIG. 24 and the table (counter latch "−A" (H)) of FIG. 29 shall be referred to from time to time.

A signal Z11GT is input as an FAS-A input-gate clock signal to the arithmetic circuit 2305 from the decoder 2304, causing the output gate 2642 of $Z^{-1}$ latch 2640 to open at an input timing of the clock signal NSCK0.

Receiving "0" as the control clock signal ZNSB from the decoder 2304, the output of AND gate 2627 outputs a low level signal, making ON the input gate 2626 of FAS 2628. Meanwhile, receiving "1" as the control clock signal ZNSA from the decoder 2304, AND gate 2625 outputs a high level signal, making OFF the input gate 2624 of FAS 2628. Further, since the control clock signal NSSUB of "0" is input from the decoder 2304 to FAS 2628, FAS 2628 performs an adding operation.

FAS 2628 adds the input value at FAS-B to the input value at FAS-A of "0", outputting at the output terminal the output of $Z^{-1}$ latch 2640 which is supplied to FAS-B.

Then, the output of the FAS 2628 passes through the limit circuit 2629 and T3 latch 2630 at an input timing of the clock signal NSCK2. Having received Z2CK as a latch clock signal from the decoder 2304, AND gate 2637 is made ON at an input timing of the clock signal NSCK3, whereby the output of the T3 latch 2630 is latched in $Z^{-2}$ latch 2636.

Through the above process, the contents of $Z^{-1}$ latch 2640 are transferred to $Z^{-2}$ latch 2636.

In $Z^{-1}$ latch 2640 and $Z^{-2}$ latch 2636 were stored data of one and two over samplings before, i.e., past data, when 3 less significant bits of an output signal of 18 bits are feed back in the noise shaping process.

For that reason, when the output of CPU 104 becomes null, a musical-tone signal output from the processing circuit 105 of FIG. 1 should be made null.

Some signal components before the output of CPU 104 becomes 0 remain in $Z^{-1}$ latch 2640 and $Z^{-2}$ latch 2636. As a result, there is a possibility that the signal components remaining in these latches are supplied to D/A converter 106 of FIG. 1, appearing as noises in the course of the noise shaping process.

To prevent generation of noise, a reset circuit 2652 surrounded by a broken line in FIG. 27 for the noise shaping process compulsorily reset $Z^{-1}$ latch 2640 and $Z^{-2}$ latch 2636 in the present embodiment, when the output of CPU 104 becomes null.

More specifically, an envelope value of 18 bits output from the envelope value output latch 214 (see FIG. 2) in CPU 104 has been input to NAND gate 2649 in FIG. 27. The output of NAND gate 2649 is supplied to reset terminals of $Z^{-1}$ latch 2640 and $Z^{-2}$ latch 2636 through A latch 2650 and B latch 2651. The output of B latch 2651 is further supplied to a reset terminal of Dz latch 2606 which outputs a dither value.

In the above arrangement, when all the envelope values of 18 bits from CPU 104 become null, the output of NAND gate 2649 goes high. The output of NAND gate 2649 is delayed by two sampling timings (interrupt timing) through A latch 2650 and B latch 2651. The delayed high level signal compulsorily resets $Z^{-1}$ latch 2640 and $Z^{-2}$ latch 2636. After $Z^{-1}$ latch 2640 and $Z^{-2}$ latch 2636 are compulsorily reset by the delayed high level signal, Dz latch 2606 which outputs a dither value is also reset compulsorily to prevent the dither value from being output.

The reasons for delaying the output of NAND gate 2649 by two sampling timings are that the latches will be reset at the same time when the arithmetic circuit 2305 performs the process, because the arithmetic circuit 2305 will take a time corresponding to two sampling timings to receive musical-tone sample data from CPU 104 and to output a musical-tone signal corresponding to the received musical-tone sample data.

Structure of Arithmetic circuit—Process 9

In a process 9 of FIG. 29 which is performed at a timing when the counter latch 2303 (FIG. 23) indicates a count number "−B" (H), 16 more significant bits of musical-tone sample data of 19 bits which are latched in T2 latch 2614 in the above process 7 of FIG. 29 are set in 0 latch 2647 as output musical-tone sample data to be supplied to D/A convertor 106 (FIG. 1), and 3 less significant bits which are cut down from the musical-tone sample data are set in $Z^{-1}$ latch 2640.

Description of the more specific operation will be given below. The timing chart of FIG. 24 and the table (counter latch "−B" (H)) of FIG. 29 shall be referred to from time to time.

A signal TM2AGT is input as an FAS-A input-gate clock signal t the arithmetic circuit 2305 from the decoder 2304, causing the output gate 2616 of T2 latch 2614 to open at an input timing of the clock signal NSCK0.

Receiving "0" as the control clock signal ZNSA from the decoder 2304, AND gate 2625 outputs a low level signal, making ON the input gate 2624 of FAS 2628. Meanwhile, receiving "1" as the control clock signal ZNSB from the decoder 2304, AND gate 2627 outputs a high level signal, making OFF the input gate 2626 of FAS 2628. Further, since the control clock signal NSSUB of "0" is input from the decoder 2304 to FAS 2628, FAS 2628 performs an adding operation.

FAS 2628 adds the input value at FAS-B of "0" to the input value at FAS-A, outputting at the output terminal the output of T2 latch 2614 which is supplied to FAS-A.

Then, the output of the FAS 2628 passes through the limit circuit 2629 and T3 latch 2630 at an input timing of the clock signal NSCK2. Having received DACK and ZlCK as latch clock signals from the decoder 2304, AND gate 2648 is made ON at an input timing of the clock signal NSCK3.

0 latch 2647 is physically constructed so as to retrieve only 16 more significant bits of the output 19 bits from T3 latch 2630 and output the 16 more significant bits without any modification. Meanwhile $Z^{-1}$ latch 2640 is physically constructed so as to retrieve only 3 less significant bits of the output 19 bits from T3 latch 2630, insert 0 to the 16 more significant bits to form data of 19 bits, and output data of 19 bits.

In this manner, 16 more significant bits of musical-tone sample data of 19 bits obtained in T2 latch 614 are latched in 0 latch 2647 and 3 less significant bits are latched in $Z^{-1}$ latch 2640.

As described above, the noise shaping process corresponding to the functional structure of FIG. 20 is performed through the processes 6 to 9 of FIG. 29.

Structure of Arithmetic Circuit—Process 10

A process 10 of FIG. 29 which is performed at a timing when the counter latch 2303 (FIG. 23) indicates a count number "−C" corresponds to the over sampling process, i.e., the linear interpolating process of FIG. 19.

In the process 10, a step value Δ/4 which is latched in Δ/4 latch 2632 in the process 4 of FIG. 29 is added to data latched in T1 latch 2610, whereby a new linear interpolating value (see FIG. 19) is calculated and latched in T1 latch 2610.

A previous linear interpolating value which was latched in the process 10 at the previous over sampling timing is stored in T1 latch 2610 at timings when the counter latch 2303 (FIG. 23) indicates a count number "1C" (H), "2C" (H) or "3C" (H), before the above calculation is performed. Similarly, new musical-tone sample data (corresponding to D1 of FIG. 19) instead of the linear interpolating value is stored in T1 latch 2610 through the process 5 of FIG. 29 at the timing the counter latch 2303 indicates a count number "0C" (H).

Description of the more specific operation will be given below. The timing chart of FIG. 24 and the table (counter latch "−C" (H)) of FIG. 29 shall be referred to from time to time.

A signal TM1GT is input as an FAS-A input-gate clock signal to the arithmetic circuit 2305 from the decoder 2304, causing the output gate 2612 of T1 latch 2610 to open at an input timing of a clock signal NSCKO. Receiving "0" as the control clock signal ZNSA from the decoder 2304, AND gate 2625 outputs a low level signal, making ON the input gate 2624 of FAS 2628. As a result, the contents of T1 latch 2610 are input to FAS 2628 through FAS-A.

Meanwhile, a signal DEFGT is input as an FAS-B input-gate clock signal to the arithmetic circuit 2305 from the decoder 2304, causing the output gate 2634 of Δ/4 latch 2632 to open at an input timing of the clock signal NSCKO. Receiving "0" as the control clock signal ZNSB from the decoder 2304, AND gate 2627 outputs a low level signal, making ON the input gate 2626 of FAS 2628. As a result, a step value Δ/4 held in Δ/4 latch 2632 is input to FAS 2628 through FAS-B.

Since a control clock signal NSSUB of "0" is input from the decoder 2304 to FAS 2628, FAS 2628 adds the step value Δ/4 of Δ/4 latch 2632 which is input through FAS-B to the output of T1 latch 2610 which is input through FAS-A.

The resultant sum passes through the limit circuit 2629 and T3 latch 2630 at an input timing of the clock signal NSCK2. Since a signal TM1CK has been input as a latch clock signal from the decoder 2304 to FAS 2628, AND gate 2611 is made ON at an input timing of the clock signal NSCK3 and the output of T3 latch 2630 is latched in T1 latch 2610.

Through the above process, the linear interpolating process is performed.

Apart from the linear interpolating process, a signal DZCK has been input as a latch clock signal from the decoder 2304 to FAS 2628. Therefore, AND gate 2607 is made ON at an input timing of the clock signal NSCK3, and a random number generated by the random number generating circuit 2653 is latched in Dz latch 2606 as a new dither value to be processed in a process 12 of FIG. 29.

Structure of Arithmetic Circuit—Process 11

A process 11 of FIG. 29 is performed at a timing when the counter latch 2303 (FIG. 23) indicates a count number "−D" (H). The process 11 is a process for transferring the linear interpolating value, which is newly obtained in the process 10 by T1 latch 2610, to T2 latch 2614 for the dither process in a process 12 to be described later and for the noise shaping process in the above described processes 6 to 9, whereby the linear interpolating process, i.e., the over sampling process, the dither process and the noise shaping process are connected in cascade.

Description of the more specific operation will be given below. The timing chart of FIG. 24 and the table (counter latch "−D" (H)) of FIG. 29 shall be referred to from time to time.

A signal TM1GT is input as an FAS-A input-gate clock signal to the arithmetic circuit 2305 from the decoder 2304, causing the output gate 2612 of T1 latch 2610 to open at an input timing of the clock signal NSCKO.

Receiving "0" as the control clock signal ZNSA from the decoder 2304, AND gate 2625 outputs a low level signal, making ON the input gate 2624 of FAS 2628. Meanwhile, receiving "1" as the control clock signal ZNSB from the decoder 2304, AND gate 2627 outputs a high level signal, making OFF the input gate 2626 of FAS 2628. Further, since the control clock signal NSSUB of "0" is input from the decoder 2304 to FAS 2628, FAS 2628 performs an adding operation.

FAS 2628 adds the input value at FAS-B of "0" to the input value at FAS-A, outputting at the output terminal the output of T2 latch 2614 which is supplied to FAS-A.

Then, the output of the FAS 2628 passes through the limit circuit 2629 and T3 latch 2630 at an input timing of the clock signal NSCK2. Having received TM2CK as the latch clock signal from the decoder 2304, AND gate 2615 is made ON at an input timing of the clock signal NSCK3. Then, the output of T3 latch 2630 is latched in T2 latch 2614.

In this manner, contents of T3 latch 2630 are transferred to T2 latch 2614.

Structure of Arithmetic Circuit—Process 12

A process 12 of FIG. 29 is performed at a timing when the counter latch 2303 (FIG. 23) indicates a count number "−E" (H). In the process 12, A dither value held in Dz latch 2606 is added to a new interpolating value replaced in T2 latch in the above process 11, and the resultant sum is newly latched in T2 latch 2614. In a similar manner to the process 3 of FIG. 29, the process 12 corresponds to the functions of the dither adding unit (Dz) 2002 and adder unit 2001 shown in FIG. 20, and the noise shaping process in the above processes 6 to 9 will be performed on the contents of T2 latch 2614 at the following over sampling timing.

Description of the more specific operation will be given below. The timing chart of FIG. 24 and the table (counter latch "−E" (H)) of FIG. 29 shall be referred to from time to time.

A signal TM2BGT is input as an FAS-B input-gate clock signal to the arithmetic circuit 2305 from the decoder 2304, causing the output gate 2619 of T2 latch 2614 to open at an input timing of a clock signal NSCKO. Receiving "0" as the control clock signal ZNSB from the decoder 2304, AND gate 2627 outputs a low level signal, making ON the input gate 2626 of FAS 2628. As a result, the contents of T1 latch 2614 are input to FAS 2628 through FAS-A.

Meanwhile, a signal DZGT is input as an FAS-A input-gate clock signal to the arithmetic circuit 2305 from the decoder 2304, causing the output gate 2608 of Dz latch 2606 to open at an input timing of the clock signal NSCKO. Receiving "0" as the control clock signal ZNSA from the decoder 2304, AND gate 2625 outputs a low level signal, making ON the input gate 2624 of FAS 2628. As a result, a dither value held in Dz latch 2606 in the random number generating unit 2653 is input to FAS 2628 through FAS-A.

Since a control clock signal NSSUB of "0" is input from the decoder 2304 to FAS 2628, FAS 2628 adds the dither value of Dz latch 2606 which is input through FAS-A to the output of T2 latch 2614 which is input through FAS-B.

The resultant sum passes through the limit circuit 2629 and T3 latch 2630 at an input timing of the clock signal NSCK2. Since a signal TM2CK has been input as a latch clock signal from the decoder 2304 to FAS 2628, AND gate 2611 is made ON at an input timing of the clock signal NSCK3 and the output of T3 latch 2630 is latched in T2 latch 2614.

In the above described embodiment, a process to be executed based on a software process under control of CPU 104 for generating a musical-tone signal and various processes to be executed by the externally provided processing circuit for controlling the musical-tone signal are performed precisely in synchronism with one another.

Second Embodiment of Reset Circuit for Noise Shaping Process

Figure 31:
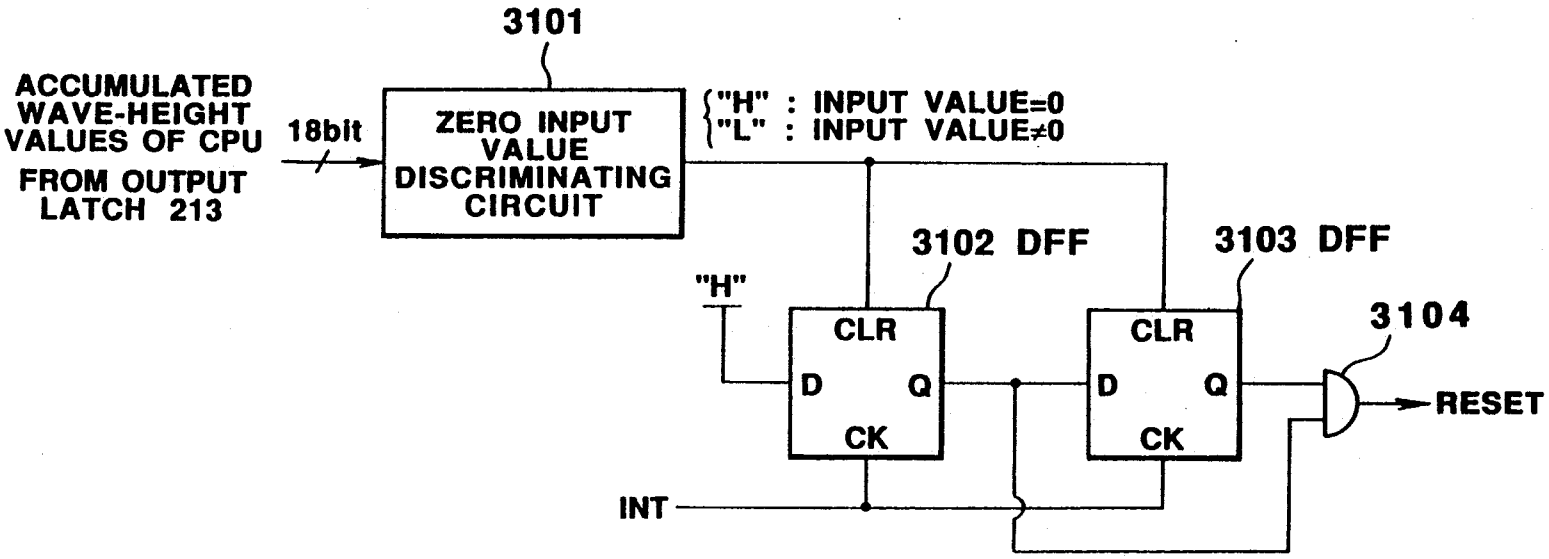
FIG. 31 is a block diagram of a second embodiment of a reset circuit of the noise shaping process.

FIG. 31 is a block diagram of a second embodiment of the reset circuit 2652 for the noise shaping process of FIG. 27.

In the above embodiment, $Z^{-1}$ latch 2640 and $Z^{-2}$ latch 2636 for the noise shaping process, and Dz latch 2606 for the dither process are reset, when envelope values of 18 bits become 0 which are output from the envelope value output latch 214 (see FIG. 2) in CPU 104.

Meanwhile, in the second embodiment of FIG. 31, the above respective latches are reset when all the accumulated wave height values of 18 bits which are output from the accumulated wave-height output latch 213 (FIG. 2) of CPU 104 (FIG. 1) remain 0 for a predetermined period.

More specifically, a zero input value discriminating circuit 3101 serves to detect a state in which all the accumulated wave height values of 18 bits become 0 which are output from the accumulated wave-height output latch 213 in CPU 104. Detecting the above state, the zero input value discriminating circuit 3101 outputs a discriminating-output signal of a high level. The present circuit 3101 may be composed of a circuit similar to NAND gate 2649 of the above described FIG. 27.

DFF 3102, 3103 are D flip-flop circuits with nonsynchronizing clear terminals (CLR), and their output terminals Q are set to a low level at a timing when the discriminating-output signal from the zero input value discriminating circuit 3101 goes low ("L"), i.e., at a timing when the zero input value discriminating circuit 3101 does not detect the state in which all the accumulated wave height values become 0.

Meanwhile, DFF 3102, 3103 each transfer a logical value at the input terminal D to the output terminal Q every time when they receive an interrupt signal INT at the clock terminals (CK) from the clock signal generating unit 203 (FIG. 2).

A voltage at the input terminal D of DFF 3102 goes high, and outputs Q of respective DFF 3102, 3103 are input to the first and second input terminals of AND circuit 3104, respectively. The output of AND circuit 3104 is supplied to reset terminals of $Z^{-1}$ latch 2640 and $Z^{-2}$ latch 2636 for the noise shaping process of FIG. 27, and Dz latch 2606 for the dither of FIG. 26.

In the arrangement of the second embodiment, DFF 3102, 3103 are always cleared unless all the accumulated wave-height values of 18 bits output from the accumulated wave-height output latch 213 in CPU 104 become zero. Since the output of AND circuit 3104 therefore goes low, $Z^{-1}$ latch 2640 and $Z^{-2}$ latch 2636 for the noise shaping process of FIG. 27, and Dz latch 2606 for the dither FIG. 26 are not reset, and wherein the above described noise shaping process and the dither process are performed.

Meanwhile, when all the accumulated wave-height values of 18 bits output from the accumulated wave-height output latch 213 in CPU 104 become zero, a high level voltage applied to the input terminal D of DFF 3102 appears at the output terminal Q of DFF 3102 at the first pulse of the interrupt signal INT thereafter supplied from CPU 104, and then the output Q of DFF 3103 goes high at the second pulse of the interrupt signal INT. As a result, both the inputs to first and second input terminals of AND circuit 3104 go high, and the output of the AND circuit 3104 goes high, whereby $Z^{-1}$ latch 2640, $Z^{-2}$ latch 2636 and Dz latch 2606 are reset. Therefore, the processing circuit 105 of FIG. 1 outputs a null musical-tone signal, suppressing noise.

When, in the above state, either of the accumulated wave-height values of 18 bits output from the accumulated wave-height output latch 213 in CPU 104 takes a value other than zero, the zero input value discriminating circuit 3101 outputs a low level value, clearing DFF 3102, 3103. Therefore, AND circuit 3104 outputs a low level value, releasing $Z^{-1}$ latch 2640, $Z^{-2}$ latch 2636 and Dz latch 2606 from the reset state and allowing the noise shaping process and the dither process to effected again.

As described above, the input interval of pulses of the interrupt signal INT is equal to a sampling cycle of the musical-tone signal. When a state should continue for a time period corresponding to two sampling cycles, the state where all the accumulated wave-height values of 18 bits output from the accumulated wave-height output latch 213 in CPU 104 become zero, the above respective latches are reset.

Even if a waveform of a musical-tone signal does not come to null, a state can occur where all the accumulated wave-height values of 18 bits output from the accumulated wave-height output latch 213 in CPU 104 take zero but the state seldom continue for a time duration corresponding to two sampling cycles. Therefore, it can be judged that the waveform of a musical-tone signal has come to null, by discriminating that the above state where all the accumulated wave-height values take zero continues for a time period corresponding to two sampling cycles, and the above latches can be reset at a timing when it is judged that the waveform of a musical-tone signal has come to null.

It should be noted that the arithmetic circuit 2305 takes a time period corresponding to two sampling cycles to output a musical-tone signal corresponding to musical-tone sample data after it receives the musical-tone sample data from CPU 104. Therefore, the above delay process for delaying by a time period corresponding to two sampling cycles includes a function to make the timing for resetting the latches coincide with the timing for the arithmetic circuit 2305 to perform a process.

Third Embodiment of Reset Circuit for Noise Shaping Process

Figure 32:
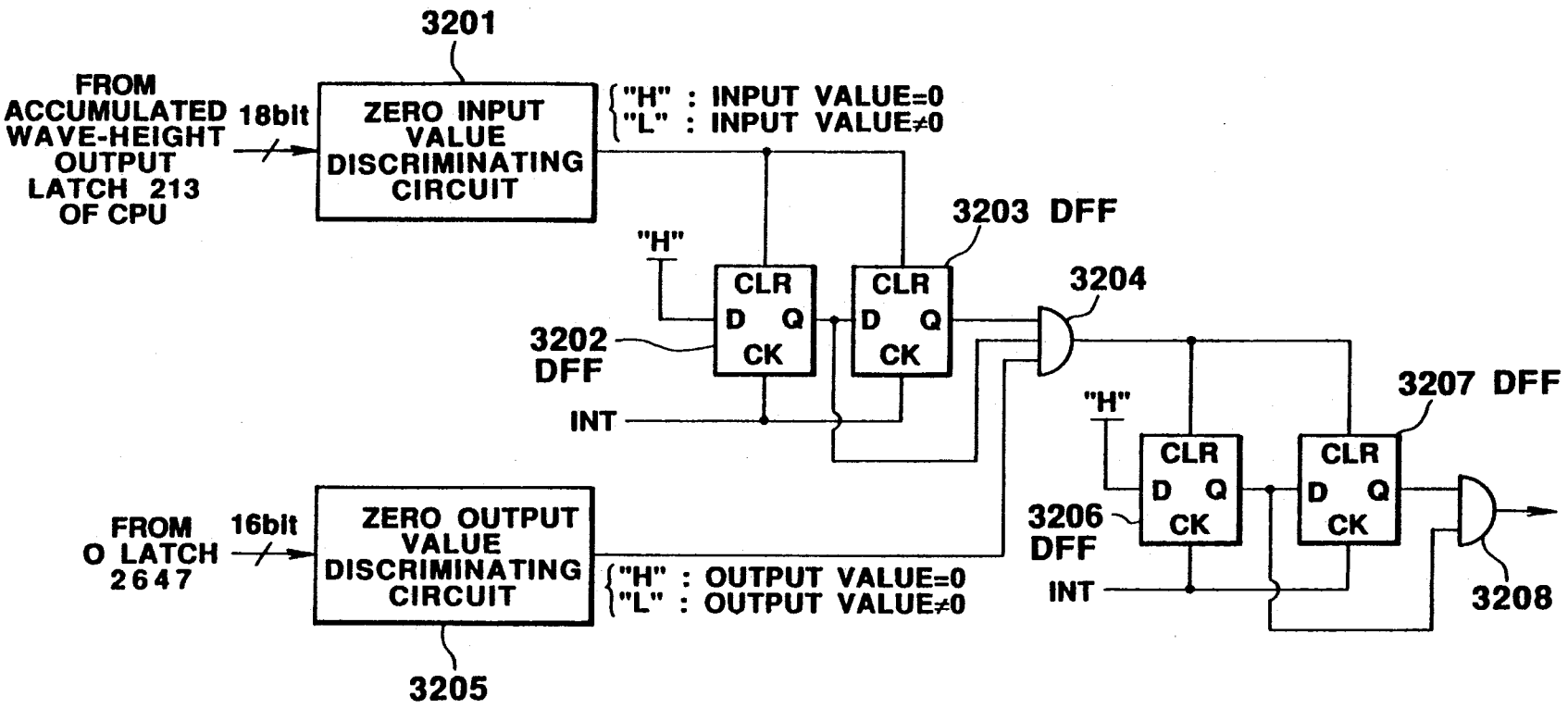
FIG. 32 is a block diagram of a third embodiment of a reset circuit of the noise shaping process.

FIG. 32 is a block diagram of a third embodiment of the reset circuit 2652 for the noise shaping process of FIG. 27.

In the above second embodiment of FIG. 31, $Z^{-1}$ latch 2640 and $Z^{-2}$ latch 2636 for the noise shaping process, and Dz latch 2606 for the dither process are arranged to be reset, when a state where all the accumulated wave height values of 18 bits output from the accumulated wave-height output latch 213 (see FIG. 2)

in CPU 104 become zero continues for a given time period.

Meanwhile, in the third embodiment of FIG. 32, the above respective latches are reset when output values of 0 latch 2647 (see FIG. 26) in the arithmetic circuit 2305 remain zero for a given time period after all the accumulated wave height values of 18 bits have remained zero for a predetermined period.

Structures of a zero input value discriminating circuit 3201, DFF 3202, 3203, and the first and second input portion of AND circuit 3204 are similar to those of relevant elements 3101 to 3104 in FIG. 31.

The zero input value discriminating circuit 3201 serves to detect a state in which all the accumulated wave height values of 18 bits output from 0 latch 2647 in the arithmetic circuit 2305 become zero. Detecting the above state, the zero input value discriminating circuit 3205 outputs a discriminating-output signal of a high level. The present circuit 3205 may be composed of a circuit similar to NAND gate 2649 of the above described FIG. 27. The discriminating-output signal output from 0 latch 2647 is input to the third input terminal of AND circuit 3204.

Similarly to DFF 3202 and 3203, DFF 3206 and 3207 are D flip-flop circuits with non-synchronizing clear terminals (CLR), and their output terminals Q are set to a low level at a timing when the discriminating-output signal from AND circuit 3204 goes low ("L").

Meanwhile, DFF 3206, 3207 each transfer a logical value at the input terminal D to the output terminal Q every time when they receive an interrupt signal INT at the clock terminals (CK) from the clock signal generating unit 203 (FIG. 2).

A voltage at the input terminal D of DFF 3206 goes high, and outputs Q of respective DFF 3206, 3207 are input to the first and second input terminals of AND circuit 3208, respectively. The output of AND circuit 3208 is supplied to reset terminals of $Z^{-1}$ latch 2640 and $Z^{-2}$ latch 2636 for the noise shaping, process of FIG. 27, and Dz latch 2606 for the dither of FIG. 26.

In the arrangement of the second embodiment, DFF 202, 3203 are always cleared and the output of AND circuit 3204 goes low, unless all the accumulated wave-height values of 18 bits output from the accumulated wave-height output latch 213 in CPU 104 become zero. DFF 3206 and 3207 therefore are always cleared and the output of AND circuit 3208 goes low. As a result, $Z^{-1}$ latch 2640 and $Z^{-2}$ latch 2636 for the noise shaping process of FIG. 27, and Dz latch 2606 for the dither of FIG. 26 are not reset, and wherein the above described noise shaping process and the dither process are performed.

Meanwhile, when a state where all the accumulated wave-height values of 18 bits output from the accumulated wave-height output latch 213 in CP 104 become zero continues for a time period corresponding to two sampling cycles, voltage at the first and second input terminals of AND circuit 3204 go high.

When, in the above state, all the output values of 0 latch 2647 (see FIG. 26) in the arithmetic circuit 2305 become zero, a voltage at the third input terminal of AND circuit 3204 goes high and a voltage at the output of AND circuit 3204 goes high. A high level state at the input terminal D of DFF 3206 appears at the output terminal Q of DFF 3207 at a time when the first pulse of the interrupt signal INT from CPU 104 is applied to DFF 3206, 3207 and then the output Q of DFF 3207 goes high at the second pulse of the interrupt signal INT. As a result, both the inputs to first and second input terminals of AND circuit 3208 go high, and the output of the AND circuit 3208 goes high, whereby $Z^{-1}$ latch 2640, $Z^{-2}$ latch 2636 and Dz latch 2606 are reset. Therefore, the processing circuit 105 of FIG. 1 suppresses noise.

When the output values of 0 latch 2647 take a value other than zero in a state where all the above output values of 0 latch 2647 are zero after a state where all the accumulated wave-height values become zero continues for a time period corresponding to two sampling cycles, the output of the zero input value discriminating circuit 3205 goes low and DFF 3206 and 3207 are cleared. As a result, the output of AND circuit 3208 goes to zero again, and $Z^{-1}$ latch 2640, $Z^{-2}$ latch 2636 and Dz latch 2606 are released from the reset state, whereby the above noise shaping process and dither process are executed again.

Therefore, when the state where all the accumulated wave-height values of 18 bits output from the accumulated wave-height output latch 213 in CPU 104 become zero continues for a time period more than two sampling cycles and further the state where all the output values of 16 bits from 0 latch 2647 become zero continues for a time period more than two sampling cycles, the respective latches are reset.

In the third embodiment, the latches are reset before the output values have been completely attenuated, whereby noise can be suppressed.

Fourth Embodiment of Reset Circuit for Noise Shaping Process

Figure 33:
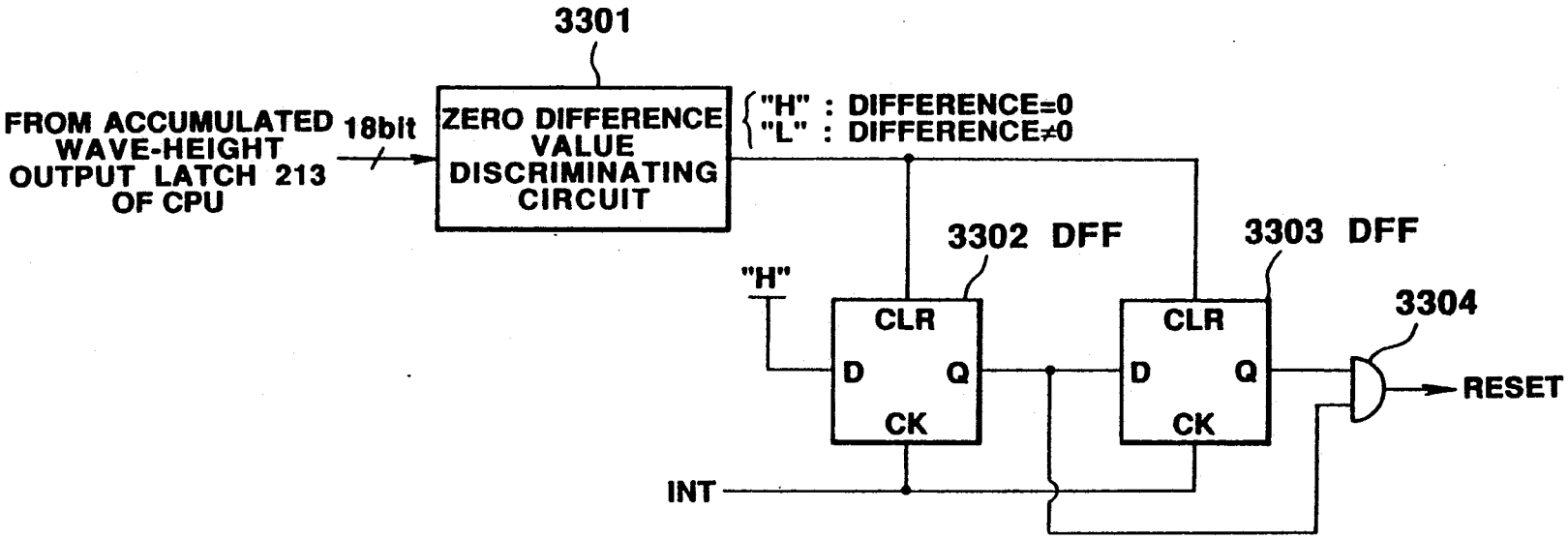
FIG. 33 is a block diagram of a forth embodiment of a reset circuit of the noise shaping process.

FIG. 33 is a block diagram of a fourth embodiment of the reset circuit 2652 for the noise shaping process of FIG. 27.

In the above second embodiment of FIG. 31, $Z^{-1}$ latch 2640 and $Z^{-2}$ latch 2636 for the noise shaping process, and Dz latch 2606 for the dither process are arranged to be reset, when a state where all the accumulated wave height of 18 bits output from the accumulated wave height output latch 213 (see FIG. 2) in CPU 104 become zero continues for a given time period.

Meanwhile, in the fourth embodiment of FIG. 33, the above respective latches are reset when a difference value in the accumulated wave-height values remains zero for a given time period.

A zero difference value discriminating circuit 3301 calculates a difference value between accumulated wave height values of 18 bits from the accumulated wave height output latch 213 in CPU 104, judges if the calculated difference value becomes zero, and outputs a discriminating signal of a high level when it judges that the difference value is zero.

DFF 3302, 3303, and AND circuit 3304 have similar structures to those of relevant elements 3102 to 3104 in FIG. 31, respectively.

In the arrangement of the fourth embodiment, DFF 3302, 3303 are always cleared and the output of AND circuit 3304 goes low, unless the difference value between the accumulated wave-height values of 18 bits output from the accumulated wave-height output latch 213 in CPU 104 become zero. As a result, $Z^{-1}$ latch 2640 and $Z^{-2}$ latch 2636 for the noise shaping process of FIG. 27, and Dz latch 2606 for the dither FIG. 26 are not reset, and wherein the above described noise shaping process and the dither process are performed.

Meanwhile, when a state where the difference value between the accumulated wave-height values of 18 bits output from the accumulated wave-height output latch 213 in CPU 104 becomes zero continues for a time period corresponding to two sampling cycles, the output of AND circuit 3204 goes high, and $Z^{-1}$ latch 2640 and $Z^{-2}$ latch 2636 and Dz latch 2606 are reset, whereby noise is suppressed.

When, in the above state, the difference value takes a value other than zero, the output of the zero difference value discriminating circuit 3301 goes low, and DFF 3302, 3303 are cleared. As a result, the output of AND circuit 3304 goes low, and $Z^{-1}$ latch 2640, $Z^{-2}$ latch 2636 and Dz latch 2606 are released from the reset state, whereby the noise shaping process and dither process are performed again.

In the fourth embodiment, even when the accumulated wave height value will take a low level direct-current value other than zero, the noise shaping process and dither process are performed again.

Other Embodiments of Reset Circuit for Noise Shaping Process

The respective embodiments of the reset circuit 2652 for the noise shaping process of FIG. 27 reset the respective latches for the noise shaping process and dither process by detecting either of the following states:

1) an envelope value of an accumulated wave height value to be input to the processing circuit 105 of FIG. 1 becomes zero;

2) an accumulated wave height value to be input to the processing circuit 105 remains zero for more than a predetermined time period;

3) an accumulated wave height value to be input to the processing circuit 105 remains zero for a given time period and then an output of the processing circuit 105 remains zero for more than a predetermined time period; and 4) a difference value of the accumulated wave height value to be input to the processing circuit 105 remains zero for more than a predetermined time period.

The apparatus according to the present invention may be arranged to reset the respective latches based on the above four states by detecting the following states:

5) an accumulated wave height value to be input to the processing circuit 105 remains zero for a given time period, and then an envelope value of an output value of the processing circuit 105 becomes zero;

6) an accumulated wave height value to be input to the processing circuit 105 remains zero for more than a predetermined time period, and then a difference value between output values of the processing circuit 10 becomes zero;

7) an envelope value of an accumulated wave height value to be input to the processing circuit 105 becomes zero, and then an output value of the processing circuit 105 remains zero for more than a predetermined time period;

8) an envelope value of an accumulated wave height value to be input to the processing circuit 105 becomes zero, and then an envelope value of an output value of the processing circuit 105 becomes zero;

9) an envelope value of an accumulated wave height value to be input to the processing circuit 105 becomes zero, and then a difference value between output values of the processing circuit 105 remains for more than a predetermined time period;

10) a difference value between accumulated wave height values to be input to the processing circuit 105 remains zero for more than a predetermined time period, and then an output value of the processing circuit 105 remains zero for more than a predetermined time period;

11) a difference value between accumulated wave height values to be input to the processing circuit 105 remains zero for more than a predetermined time period, and then an envelope value of an output value of the processing circuit 105 becomes zero; and 12) a difference value between accumulated wave height values to be input to the processing circuit 105 remains zero for more than a predetermined time period, and then a difference value of output values of the processing circuit 105 remains zero for more than a predetermined time period.

It is not always necessary to detect that the difference value remains zero for a give time period, but it may be enough to detect that the difference value takes zero once.

Other Embodiments

Figure 34:
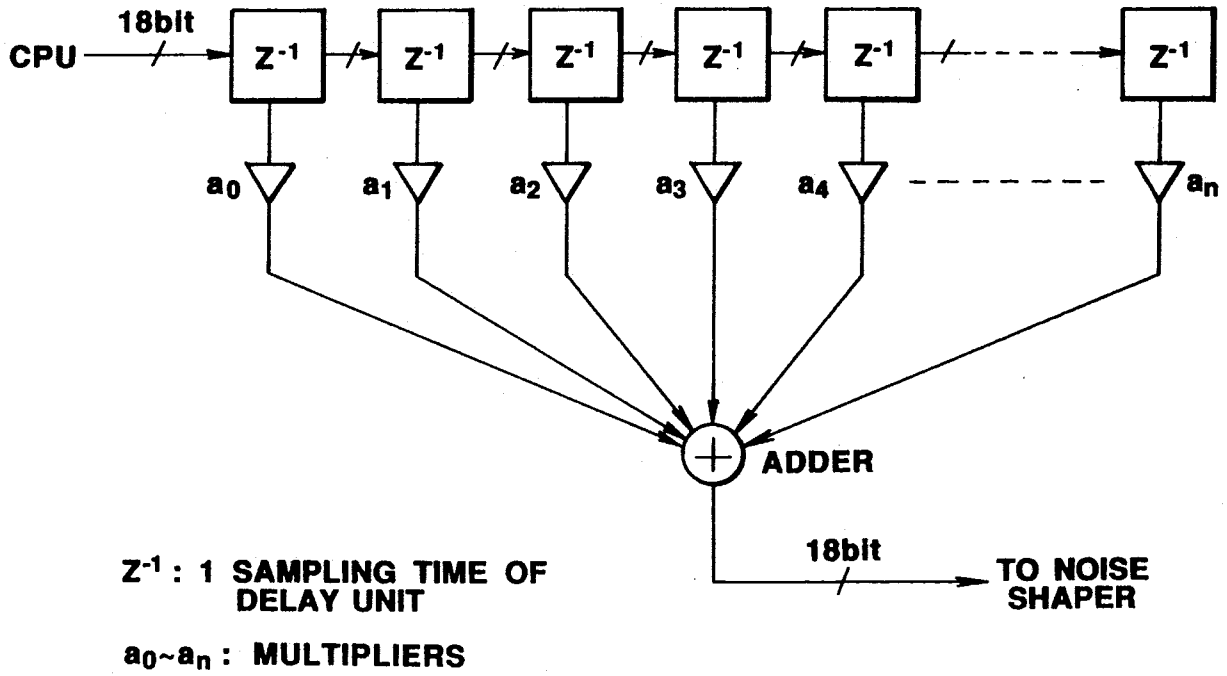
FIG. 34 is a view illustrating function of a digital low pass filtering process in another embodiment of the present invention.

In the above described embodiments, the processing circuit 105 of FIG. 1 includes the arithmetic circuit 2305 of FIG. 23 having a structure shown in FIGS. 26 and 27, and allows the arithmetic circuit 2305 to execute the linear interpolating process such as the processes 4 and 10 of FIG. 29 based on the principle of FIG. 19 to obtain effects of the over sampling process. To execute the over sampling process with high accuracy, the digital low pass filtering process having functions of FIG. 34 that cut harmonic frequency components within a range higher than the frequency range of the original sound signal may be directly executed as a digital signal process to be performed by DSP and the like, as described with reference to FIGS. 17 and 18.

In the above embodiments, the processing circuit 105 in FIG. 105 has been described as a circuit for executing the over sampling process, noise shaping process and dither process. But the processing circuit is not limited to the above, a circuit for adding effects as reverberation effect and tremolo effect to a musical tone signal may be used as the processing circuit.

Further, in the above embodiment, CPU 104 of FIG. 1 generates a monophonic musical-tone signal, and the processing circuit 105 processes the monophonic musical-tone signal, supplying the same to D/A convertor 106. CPU 105, the processing circuit 105 and D/A convertor 106 may be arranged so as to generate, control and output a stereophonic musical-tone signal.

For example, two units of input latches 2601 (see FIG. 26) may be provided in the arithmetic circuit 2305 (FIG. 23) for processing stereophonic musical-tone sample data from CPU 104, and the arithmetic circuit 2305 may be of a hardware structure for executing the over sampling process in a time sharing fashion on musical-tone sample data from the input latches.

As have been described in detail, in the apparatus according to the first and second aspects of the present invention, even though output timing of musical-tone sample data varies in the processor, the synchronizing means absorbs the variation in output timing of the sample data, allowing the musical-tone sample data to be input from the processor at a precise time interval. The output timing at which the processor outputs musical-tone sample data may precisely coincide with the timing at which the processing circuit executes a musical-tone controlling process on the respective musical-tone sample data.

As a result, such a high-performance electronic musical instrument including a combination of a general purpose processor and a proper processing circuit may be available that is capable of performing a precise and complex musical-tone control.

In the apparatus according to the third aspect of the present invention, even though the processing circuit starts operation independently within a short time period between the time when the power is turned on and the time when the processor initializes relevant internal elements, the processing circuit does not generate an undesired musical-tone signal, suppressing noise.

As a result, such a high-performance electronic musical instrument including a combination of a general purpose processor and a proper processing circuit may be available that is capable of performing a precise and more complex musical-tone control.

In the apparatus according to the fourth aspect of the present invention, undesired noise components based on old sample data remaining in the delay unit may be suppressed, because contents of the delay unit for delaying musical-tone signal are compulsorily reset or cleared, when an input musical-tone signal is made to a null state.

In the apparatus according to the fifth aspect of the present invention, generation of undesired noise may be prevented, because contents of the delay unit for delaying musical-tone signal are compulsorily reset or cleared, when an output musical-tone signal is brought to a null state after an input musical-tone signal has been brought to a null state.

In the apparatus according to the fourth or fifth aspect of the present invention, the null input-signal discriminating means can judge that the input musical-tone signal has become null, by discriminating that the amplitude envelope of the input musical-tone signal has become null or the amplitude of the input musical-tone signal remains to be null for more than a predetermined time duration while the null output-signal discriminating means can judge that the output musical-tone signal has become null by discriminating that the amplitude envelope of the output musical-tone signal has become null or the amplitude of the output musical-tone signal remains to be null for more than a predetermined time duration.

Further, the null input-signal discriminating means can judge that the input musical-tone signal has become null by discriminating that the difference between the amplitudes of the input musical-tone signal has become null while the null output-signal discriminating means can judge that the output musical-tone signal has become null, by discriminating that the variation in amplitude of the output musical-tone signal has become null. In these cases, even when the amplitude of the input or output musical-tone signal has become null or has become to a low D.C. level, the contents of the delay section can be reset or cleared.

What is claimed is:

1. A musical-tone signal generating apparatus comprising:

processor mean for executing a sound-source processing program at predetermined intervals to successively produce musical-tone sample data;

synchronizing means for storing the musical-tone sample data produced by said processor means, and for outputting the stored musical-tone sample data at time intervals which are equal to the predetermined intervals; and processing circuit means for executing a musical-tone controlling process on the musical-tone sample data received from said synchronizing means.

2. A musical-tone signal generating apparatus comprising:

processor mean for executing a sound-source processing program at predetermined intervals to successively produce stereophonic musical-tone sample data;

synchronizing means for storing the stereophonic musical-tone sample data produced by said processor means, and for outputting the stored stereophonic musical-tone sample data at time intervals which are equal to said predetermined intervals; and processing circuit means for executing in a time sharing fashion a musical-tone controlling process on the stereophonic musical-tone sample data received from said synchronizing means.

3. A musical-tone signal generating apparatus comprising:

processor means for executing a sound-source processing program to successively produce musical-tone sample data;

processing circuit means for executing a musical-tone controlling process, by means of hardware, on the musical-tone sample data produced by said processor means; and reset means for compulsorily resetting said processing circuit means when power to the apparatus is turned on.

4. A musical-tone signal controlling apparatus which executes a musical-tone controlling process including a delay process on an input musical-tone signal to be supplied to the apparatus, the apparatus comprising:

delay unit means for executing the delay process on the input musical-tone signal;

discriminating means for determining whether or not the input musical-tone signal to be supplied to the apparatus has become null; and reset means for compulsorily resetting said delay unit means when said discriminating means determines that that input musical-tone signal to be supplied to the apparatus has become null.

5. The apparatus according to claim 4, wherein said discriminating means determines that the input musical-tone signal has become null when said discriminating means determines that an amplitude envelope of the input musical-tone signal has become null.

6. The apparatus according to claim 4, wherein said discriminating means determines that the input musical-tone signal has become null when said discriminating means determines that an envelope of the input musical-tone signal has remained null for more than a predetermined duration.

7. The apparatus according to claim 4, wherein said discriminating means determines that the input musical-tone signal has become null when said discriminating means determines that a difference between amplitudes of the input musical-tone signal has become null.

8. A musical-tone signal controlling apparatus comprising:

processor means for executing a musical-tone controlling process on an input musical-tone signal supplied to said processor means, said processor means including delay unit means for executing a delay process on the input musical-tone signal;

first discriminating means for determining whether or not the input musical-tone signal to be supplied to said processor means has become null;

second discriminating means for determining whether or not the musical-tone signal processed by said processor means has become null; and reset means for compulsorily resetting said delay unit means when said second discriminating means determines that the musical-tone signal processed by said processor means has become null after said first discriminating means determines that the input musical-tone signal to be supplied to said processor means has become null.

9. The apparatus according to claim 8, wherein said first discriminating means determines that the input musical-tone signal has become null when said first discriminating means determines that an envelope of the input musical-tone signal has remained null for more than a predetermined time duration; and said second discriminating means determines that the musical-tone signal processed by said processor means has become null when said second discriminating means determines that an envelope of the musical-tone signal processed by said processor means has remained null for more than a predetermined time duration.

10. The apparatus according to claim 8, wherein said first discriminating means determines that the input musical-tone signal has become null when said first discriminating means determines that an envelope of the input musical-tone signal has remained null for more than a predetermined time duration; and said second discriminating means determines that the musical-tone signal processed by said processor means has become null when said second discriminating means determines that an amplitude envelope of the musical-tone signal processed by said processor means has become null.

11. The apparatus according to claim 8, wherein said first discriminating means determines that the input musical-tone signal has become null when said first discriminating means determines that an envelope of the input musical-tone signal has remained null for more than a predetermined time duration; and said second discriminating means determines that the output musical-tone signal has become null when said second discriminating means determines that a difference between amplitudes of the musical-tone signals processed by said processor means has become null.

12. The apparatus according to claim 8, wherein said first discriminating means determines that the input musical-tone signal become null when said first discriminating means determines that an amplitude envelope of the input musical-tone signal has become null; and said second discriminating means determines that the musical-tone signal processed by said processor means has become null when said second discriminating means determines that an envelope of the musical-tone signal processed by said processor means has remained null for more than a predetermined time duration.

13. The apparatus according to claim 8, wherein said first discriminating means determines that the input musical-tone signal has become null when said first discriminating means determines that an amplitude envelope of the input musical-tone signal has become null; and said second discriminating means determines that the musical-tone signal processed by said processor means has become null when said second discriminating means determines that an amplitude envelope of the musical-tone signal processed by said processor means has become null.

14. The apparatus according to claim 8, wherein said first discriminating means determines that the input musical-one signal has become null when said first discrimination means determines that an amplitude envelope of the input musical-tone signal has become null; and said second discriminating means determines that the output musical-tone signal has become null when said second discriminating means determines that a difference between amplitudes of the musical-tone signals processed by said processor means has become null.

15. The apparatus according to claim 8, wherein said first discriminating means determines that the input musical-tone signal has become null when said first discriminating means determines that a variation in amplitude of the input musical tone signal has become null; and said second discriminating means determines that the output musical-tone signal has become null when said second discriminating means determines that an envelope of the output musical-tone signal has remained null for more than a predetermined time duration.

16. The apparatus according to claim 8, wherein said first discriminating means determines that the input musical-tone signal has become null when said first discriminating means determines that a difference in amplitudes of the input musical-tone signals has become null; and said second discriminating means determines that the musical-tone signal processed by said processing means has become null when said second discriminating means determines that an amplitude envelope of the musical-tone signal processed by said processor means has become null.

17. The apparatus according to claim 8, wherein said first discriminating means determines that the input musical-tone signal has become null when said first discriminating means determines that a difference in amplitudes of the input musical-tone signals has become null; and said second discriminating means determines that the musical-tone signal processed by said processor means has become null when said second discriminating means determines that a difference between amplitudes of the musical-tone signals processed by said processor means has become null.

* * * * *